US007267339B2

(12) United States Patent
Mitsuya et al.

(10) Patent No.: US 7,267,339 B2
(45) Date of Patent: Sep. 11, 2007

(54) OVERLAPPED-SHEET DETECTION APPARATUS

(75) Inventors: Yusuke Mitsuya, Kanagawa-ken (JP); Yukio Asari, Kanagawa-ken (JP); Yoshihiko Naruoka, Kanagawa-ken (JP); Koji Kurokawa, Kanagawa-ken (JP)

(73) Assignee: Kabushiki Kaisha Toshiba, Toyko (JP)

( * ) Notice: Subject to any disclaimer, the term of this patent is extended or adjusted under 35 U.S.C. 154(b) by 0 days.

(21) Appl. No.: 11/395,170

(22) Filed: Apr. 3, 2006

(65) Prior Publication Data

US 2006/0186594 A1 Aug. 24, 2006

Related U.S. Application Data

(62) Division of application No. 10/808,325, filed on Mar. 25, 2004, now Pat. No. 7,052,008.

(30) Foreign Application Priority Data

May 14, 2003 (JP) ..... 2003-136193
Feb. 24, 2004 (JP) ..... 2004-048171

(51) Int. Cl.
*B65H 7/12* (2006.01)

(52) U.S. Cl. ..... 271/262; 271/263; 271/125

(58) Field of Classification Search ..... 271/262, 271/263, 122, 125, 182
See application file for complete search history.

(56) References Cited

U.S. PATENT DOCUMENTS 4,203,586 A * 5/1980 Hoyer ..... 271/34
4,627,607 A 12/1986 Ishii
5,118,091 A * 6/1992 Nagamoto et al. ..... 271/122

(Continued)

FOREIGN PATENT DOCUMENTS

JP 59-12029 1/1984

(Continued)

OTHER PUBLICATIONS

English Abstract for JP 3-191493.*

(Continued)

*Primary Examiner*—Patrick Mackey
*Assistant Examiner*—Thomas Morrison
(74) *Attorney, Agent, or Firm*—Pillsbury Winthrop Shaw Pittman LLP

(57) ABSTRACT

An overlapped-sheet detection apparatus can detect whether sheets are overlapped and shift the same, if overlapped, for further processing. The overlapped-sheet detection apparatus is provided with conveying belts, forwarding and shifting rollers, motor and discriminator. Conveying belts hold and convey sheets on a conveying path. Forwarding roller is provided at the conveying path to forward sheets in a conveying direction and forward sheets in conveying direction. Shifting roller is provided opposite to forwarding roller to shift sheets back to a direction which is the reverse of conveying direction if the sheets are overlapped. Motor supplies shifting roller with driving torque to shift sheets back to the direction reversed to conveying direction. An encoder is built in motor to detect a rotation state of shifting roller. Discriminator judges from an output of the encoder whether sheets are overlapped. When sheets are overlapped, forwarding roller makes contact with upper sheet and sends the same in conveying direction but shifting roller shifts lower sheet in a direction reversed to conveying direction.

4 Claims, 15 Drawing Sheets

U.S. PATENT DOCUMENTS

| | | | | |
|---|---|---|---|---|
| 5,351,945 | A | | 10/1994 | Asakawa et al. |
| 5,435,540 | A | * | 7/1995 | Martin et al. ..... 271/122 |
| 5,505,440 | A | | 4/1996 | Uematsu |
| 6,129,351 | A | * | 10/2000 | Oohara et al. ..... 271/262 |
| 6,695,301 | B1 | * | 2/2004 | Tratar ..... 271/3.13 |
| 6,788,440 | B1 | | 9/2004 | Sashida |

FOREIGN PATENT DOCUMENTS

| | | | |
|---|---|---|---|
| JP | 1-192647 | | 8/1989 |
| JP | 2-204251 | * | 8/1990 |
| JP | 3-191493 | * | 8/1991 |
| JP | 4-164748 | | 6/1992 |
| JP | 6-166446 | | 6/1994 |
| JP | 7-10322 | | 1/1995 |
| JP | 11-334938 | | 12/1999 |

OTHER PUBLICATIONS

English Abstract for JP 2-204251.*

* cited by examiner

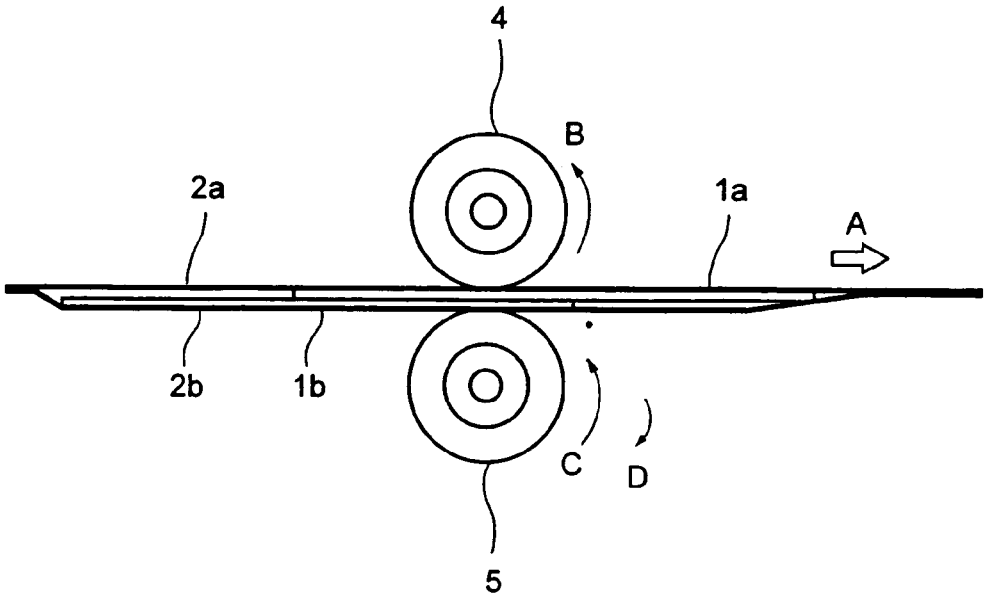
FIG. 3A
FIG. 3B
FIG. 3C
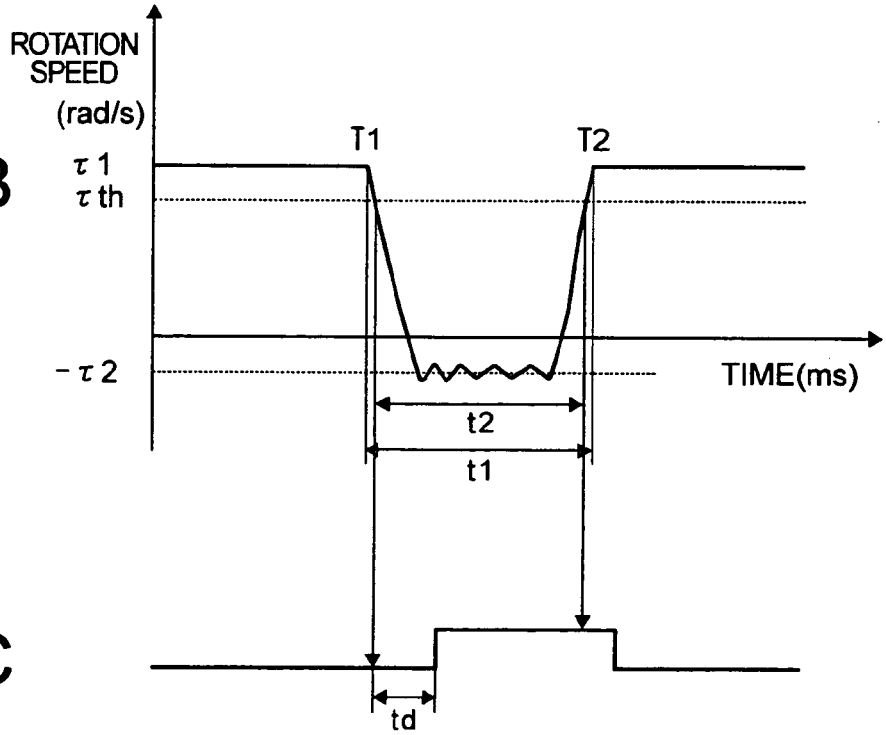

OVERLAPPED-SHEET DETECTION APPARATUS

This application is a divisional of U.S. application Ser. No. 10/808,325, filed Mar. 25, 2004, now U.S. Pat. No. 7,052,008, which is based upon and claims the benefit of priority from the prior Japanese Patent Application Nos. P2003-136193, filed May 14, 2003 and P2004-48171, filed on Feb. 24, 2004. This application is also related to U.S. application Ser. No. 11/295,518, filed Dec. 7, 2005, the entire contents of all of which are incorporated herein by reference.

FIELD OF THE INVENTION

This invention generally relates to an overlapped-sheet detection apparatus and, more particularly, to an overlapped-sheet detection apparatus for detecting overlapped sheets such as bank notes and postal matters.

BACKGROUND OF THE INVENTION

In general, a sheet handling system inspects and processes sheets such as bank notes or bills to determine whether the bills are genuine or forged and whether they are usable or discarded. Thus, it is quite important to detect overlapped sheets. For that purpose, an overlapped-sheet detection apparatus is installed in the sheet handling system.

A conventional overlapped-sheet detection apparatus is disclosed in Japanese Unexamined Patent Publication Tokkaihei 7-10322. First, the overlapped-sheet detection apparatus measures a length of sheets along a conveying direction at its entrance. The overlapped-sheet detection apparatus is provided with two conveying belts driven at different speeds. The first and second conveying belts are in contact with the surface and back of the sheets, respectively. Since the sheets are conveyed at different speeds, they are separate from each other. Then, the overlapped-sheet detection apparatus measures again a length of sheets along the conveying direction at its exit. If the data measured satisfy the following equation, the overlapped-sheet detection apparatus judges overlapped sheets:

$$(Lout-Lin)>Ld$$

where "Lin" is a length of sheets measured at the entrance, "Lout" is a length of sheets measured at the exit, and "Ld" is a predetermined judgment level of overlapped sheets.

However, the overlapped-sheet detection apparatus, cannot always detect overlapped sheets correctly in the case where the difference in conveying speeds for the first and second conveying belts is small because the overlapped sheets are not so readily separate as they are supposed to be. If the difference of conveying speeds is set to be higher to overcome such a problem, the first and second conveying belts are worn out short of their expected life.

SUMMARY OF THE INVENTION

Accordingly, the present invention is for solving the problem set forth above and provides an overlapped-sheet detection apparatus that can securely detect overlapped sheets.

The first aspect of the present invention is directed to a overlapped-sheet detection apparatus provided with a conveying path on which sheets are conveyed, a forwarding roller provided at the conveying path to forward the sheets in a conveying direction, a shifting roller provided opposite to the forwarding roller to shift the sheets back to a reverse direction of the conveying direction if the sheets are overlapped, a motor for supplying the shifting roller with driving torque to shift the sheets back to a reverse direction of the conveying direction, a rotation detection unit for detecting a rotation state of the shifting roller, and a discriminator for judging from an output of the rotation detection unit that the sheets are overlapped, wherein the rotation detection unit includes an encoder and the discriminator compares an output of the encoder with predetermined reference rotation speed and reference time to judge if the sheets are overlapped.

The second aspect of the present invention is directed to an overlapped-sheet detection apparatus provided with a conveying path on which sheets are conveyed, a forwarding roller provided at the conveying path to forward the sheets in a conveying direction, a shifting roller provided opposite to the forwarding roller to shift the sheets back to a reverse direction of the conveying direction if the sheets are overlapped, a motor for supplying the shifting roller with driving torque to shift the sheets back to a reverse direction of the conveying direction, an entrance sensor disposed closer to an entrance of the conveying path than the forwarding roller to measure a first length of the sheets along the conveying direction, an exit sensor disposed closer to an exit of the conveying path than the forwarding roller to measure a second length of the sheets along the conveying direction, and an overlapped-sheet detection unit for determining when the sheets are overlapped by detecting a difference between the first and second lengths supplied from the entrance and exit sensors.

The third aspect of the present invention is directed to an overlapped-sheet detection apparatus provided with a forwarding roller rotating while making contact with sheets to forward the sheets, a shifting roller provided at a position where the shifting roller and the forwarding roller pinch at the sheets, wherein the shifting roller is configured to shift the sheets if the sheets are overlapped and to follow a rotation of the forwarding roller if the sheets are not overlapped, driving torque means for supplying the shifting roller with driving torque to shift the sheets, detection means for detecting rotation states of the shifting roller, discrimination means for judging from the rotation states detected by the detection means that the sheets are overlapped, and control means for controlling the driving torque means to transmit less driving torque than in ordinary cases when the discrimination means judges that the sheets are overlapped.

The fourth aspect of the present invention is directed to an overlapped-sheet detection apparatus provided with a forwarding roller rotating while making contacting with sheets to forward the sheets in a conveying direction, a shifting roller provided at a position where the shifting roller and the forwarding roller pinch at the sheets, wherein the shifting roller is configured to shift the sheets if the sheets are overlapped and to follow a rotation of the forwarding roller if the sheets are not overlapped, driving torque means for supplying the shifting roller with driving torque to shift the sheets in a rotation direction and with returning torque in another direction which is the reverse of the rotation direction, detection means for detecting rotation states of the shifting roller, discrimination means for judging from the rotation states detected by the detection means whether the sheets are overlapped or not, measurement means for measuring a shift of the sheets made by the shifting roller from the rotation states detected by the detection means, and control means for controlling the driving torque means to transmit the returning torque to the shifting roller so that the sheets are shifted in a reverse direction of the conveying direction in accordance with the shift measured by the measurement means.

The fifth aspect of the present invention is directed to a method of detecting overlapped sheets consisting of rotating a forwarding roller while the forwarding roller makes contact with sheets to forward the sheets in a conveying direction, providing a shifting roller at a pinch position where the shifting roller and the forwarding roller pinch at the sheets, providing the shifting roller with shifting torque to shift the sheets if the sheets are overlapped, allowing the shifting roller to follow a rotation of the forwarding roller if the sheets are not overlapped, detecting rotation states of the shifting roller to which the shifting torque is provided while conveying the sheets, judging that the sheets are overlapped when the rotation states are changed, and transmitting less torque than the shifting torque to the shifting roller so that the sheets are shifted less.

The sixth aspect of the present invention is directed to a method of detecting overlapped sheets consisting of rotating a forwarding roller while the forwarding roller makes contact with sheets to forward the sheets in a conveying direction, providing a shifting roller at a pinch position where the shifting roller and the forwarding roller pinch at the sheets, providing the shifting roller with shifting torque to shift the sheets if the sheets are overlapped, allowing the shifting roller to follow a rotation of the forwarding roller if the sheets are not overlapped, detecting rotation states of the shifting roller to which the shifting torque is provided while conveying the sheets, judging that the sheets are overlapped when the rotation states are changed, measuring a shift of the sheets made by the shifting roller, and transmitting returning torque based on the shift measured to the shifting roller to shift the sheets in a reverse direction of the conveying direction.

The seventh aspect of the present invention is directed to an overlapped-sheet detection apparatus provided with a first forwarding roller rotating while making contact with sheets to forward the sheets in a conveying direction on a conveying path, a shifting roller provided at a position where the shifting roller and the first forwarding roller pinch the sheets, wherein the shifting roller is configured to shift the sheets if the sheets are overlapped and to follow a rotation of the first forwarding roller if the sheets are not overlapped, driving torque means for supplying the shifting roller with driving torque to shift the sheets, detection means for detecting rotation states of the shifting roller, discrimination means for judging from the rotation states detected by the detection means whether the sheets are overlapped or not, a second forwarding roller provided closer to an entrance than to the first forwarding roller, wherein the second forwarding roller rotates while making contact with sheets to forward the sheets between the first forwarding and shifting rollers, and depression means for depressing the second forwarding roller against the sheets.

The eighth aspect of the present invention is directed to an overlapped-sheet detection apparatus provided with a forwarding roller rotating while making contact with sheets to forward the sheets in a conveying direction on a conveying path, a shifting roller provided at a position where the shifting roller and the first forwarding roller pinch at the sheets, wherein the shifting roller is configured to shift the sheets if the sheets are overlapped and to follow a rotation of the first forwarding roller if the sheets are not overlapped, driving torque means for supplying the shifting roller with driving torque to shift the sheets, a first sensor provided closer to an entrance than to the forwarding roller to detect a rear edge portion of the sheets in the conveying direction, a second sensor provided between the first sensor and the forwarding roller to detect the rear edge portion of the sheets in the conveying direction, and discrimination means for judging whether the sheets are overlapped or not from a period of time taken between detection of the rear edge portion of the sheets by the first and that of the rear edge portion of the sheets by second sensor.

The ninth aspect of the present invention is directed to an overlapped-sheet detection apparatus provided with a forwarding roller rotating while making contact with sheets to forward the sheets in a conveying direction on a conveying path, a shifting roller provided at a position where the shifting roller and the first forwarding roller pinch the sheets, wherein the shifting roller being configured to shift the sheets if the sheets are overlapped and to follow a rotation of the first forwarding roller if the sheets are not overlapped, driving torque means for supplying the shifting roller with driving torque to shift the sheets, detection means for detecting rotation speeds of the shifting roller, and discrimination means for judging that the sheets are overlapped when a difference between the rotation speed of the shifting roller and that of the forwarding roller is greater than a threshold value.

The tenth aspect of the present invention is directed to an overlapped-sheet detection apparatus provided with a forwarding roller rotating while making contact with sheets to forward the sheets in a conveying direction on a conveying path, a shifting roller provided at a position where the shifting roller and the first forwarding roller pinch at the sheets, wherein the shifting roller being configured to shift the sheets if the sheets are overlapped and to follow a rotation of the first forwarding roller if the sheets are not overlapped, driving torque means for supplying the shifting roller with driving torque to shift the sheets, detection means for detecting rotation speeds of the shifting roller, first discrimination means for judging that the sheets are overlapped when a difference between the rotation speed of the shifting roller and that of the forwarding roller is greater than a threshold value, a first sensor provided closer to an entrance of the conveying path than to the forwarding roller for detecting a rear edge portion of the sheets in the conveying direction, a second sensor provided between the first sensor and the forwarding roller for detecting the rear edge portion of the sheets in the conveying direction, and second discrimination means for judging whether the sheets are overlapped from a period of time taken between detection of the rear edge portion of the sheets by the first sensor and that of the rear edge portion of the sheets by second sensor.

BRIEF DESCRIPTION OF THE DRAWINGS

A more complete appreciation of the present invention and many of its attendant advantages will be readily obtained as the same becomes better understood by reference to the following detailed descriptions when considered in connection with the accompanying drawings, wherein:

FIG. 3A is a schematic side view of the overlapped-sheet detection apparatus to explain its operations when overlapped sheets are conveyed;

FIG. 3B is a rotation speed characteristic diagram of a shifting roller of the overlapped-sheet detection apparatus when overlapped sheets are conveyed;

FIG. 3C is a detection timing chart of the overlapped sheets;

DESCRIPTION OF THE PREFERRED EMBODIMENTS

Figure 1A:
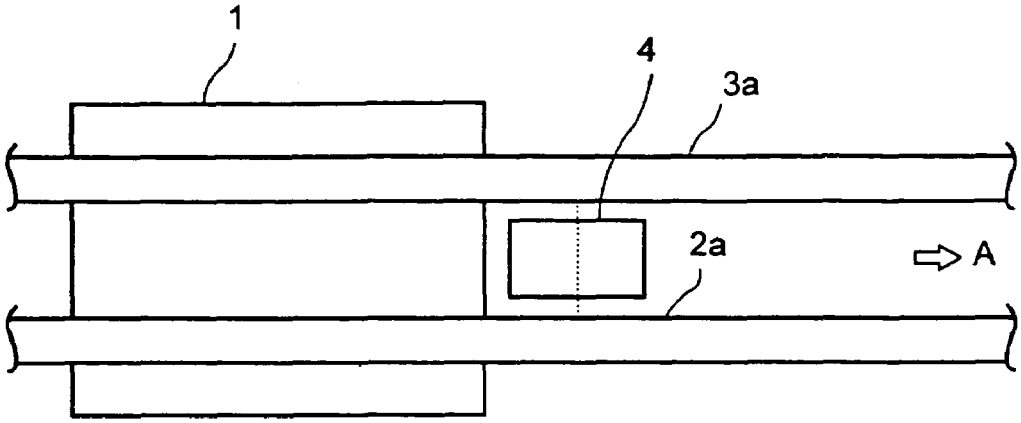
FIGS. 1A and 1B are schematic plan and side views of an overlapped-sheet detection apparatus according to the first embodiment of the present invention, respectively.

Embodiments of the present invention will be explained below with reference to the attached drawings. It should be noted that the present invention is not limited to the embodiments but covers their equivalents. Throughout the attached drawings, similar or same reference numerals show similar, equivalent or same components. The drawings, however, are shown schematically for the purpose of explanation so that their components are not necessarily the same in shape or dimension as actual ones. In other words, concrete shapes or dimensions of the components should be considered as described in these specifications, not in view of the ones shown in the drawings. Further, some components shown in the drawings may be different in dimension or ratio from each other.

First Embodiment

FIGS. 1A and B show schematic plan and side views of an overlapped-sheet detection apparatus in accordance with the first embodiment of the present invention, respectively.

Figure 1B:
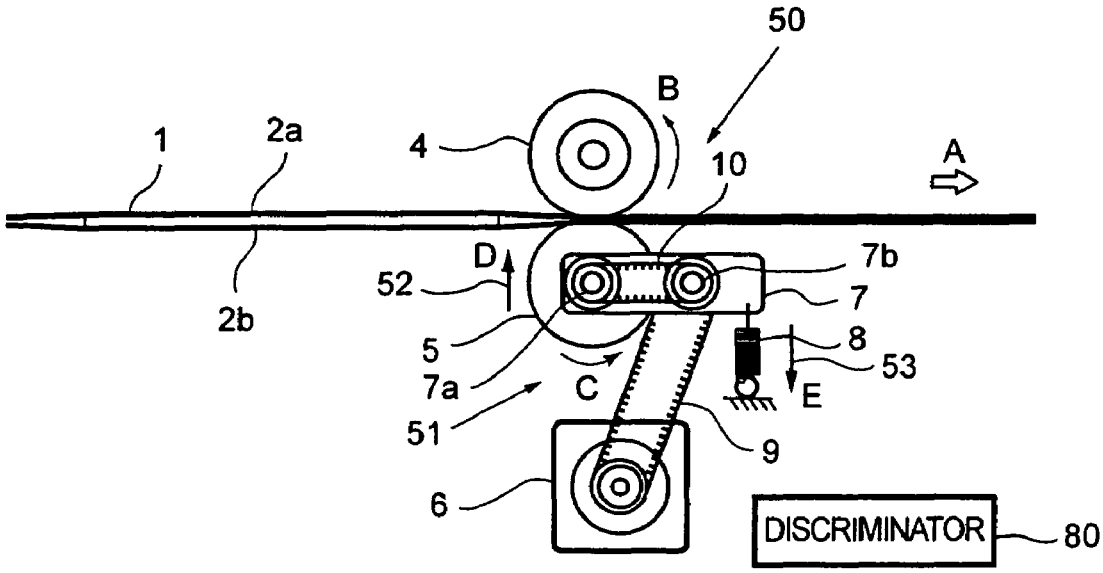

The overlapped-sheet detection apparatus primarily consists of a pair of conveying belts 2*a* and 2*b* and another pair of conveying belts 3*a* and 3*b* to convey sheet 1 in direction A as indicated by an arrow and overlapped-sheet detection unit 50. Conveying belts 2*a* and 2*b* are substantially the same in structure as belts 3*a* and 3*b*. As shown in FIG. 1B, conveying belt 2*b* is provided underneath conveying belt 2*a*. Similarly, conveying belt 3*b* is also provided underneath conveying belt 3*a* but is not shown in FIG. 1B. Conveying belts 3*a* and 3*b* carry out substantially the same operations as conveying belts 2*a* and 2*b* as will be seen in light of the side view shown in FIG. 1B.

Overlapped-sheet detection unit 50 is positioned between conveying belts 2*a* and 2*b* and conveying belts 3*a* and 3*b* and includes forwarding roller 4, shifting roller unit 51 and discriminator 80. Forwarding roller 4 sends sheet 1 such as a bill (bank note) conveyed by conveying belts 2*a*, 2*b*, 3*a* and 3*b* in direction A. Shifting roller unit 51 positioned opposite to forwarding roller 4 produces a torque to shift the bill in a reverse direction with respect to direction A.

Shifting roller unit 51 consists of shifting roller 5, torque control motor 6, pinch arm 7, spring 8, and timing belts 9 and 10. Timing belt 9 is coupled between a wheel rotationally fixed at axis 7*b* of pinch arm 7 and the one fixed at the axis of torque control motor 6. The wheel fixed at axis 7*b* is further coupled with that fixed at axis 7*a* by timing belt 10. Thus, rotation torque of motor 6 is transmitted to roller 5 through timing belts 9 and 10. Spring 8 is provided to rotate pinch arm 7 around axis 7*b*. Motor 6 includes an encoder to detect its rotation speed.

With the structure of overlapped-sheet detection unit 50, conveying belts 2*a* and 2*b* (collectively "conveying belts 2") and conveying belts 3*a* and 3*b* (collectively "conveying belts 3") hold and convey sheet 1 in direction A.

When sheet 1 is conveyed in direction A, a circumferential speed of forwarding roller 4 rotating in direction B is set at a conveying speed of conveying belts 2 and 3. Shifting roller 5 is pressed against forwarding roller 4 by pinch force 52 in direction D indicated by an arrow while shifting roller 5 is supplied with shifting torque in rotation direction C indicated by an arrow. Since driving torque of forwarding roller 4 in rotation direction B indicated by an arrow is set to be greater than that of shifting roller 5 in direction C, the rotation of shifting roller 5 is driven by and follows that of forwarding roller 4 in ordinary cases (that no sheet or one sheet is conveyed).

Here, pinch force 52 in direction D is due to the rotation moment of pinch arm 7 rotated around axis 7*b* by spring force 53 of spring 8 biased in direction E.

A method of detecting overlapped sheets will be described below with reference to FIGS. 2 and 3.

Figure 2A:
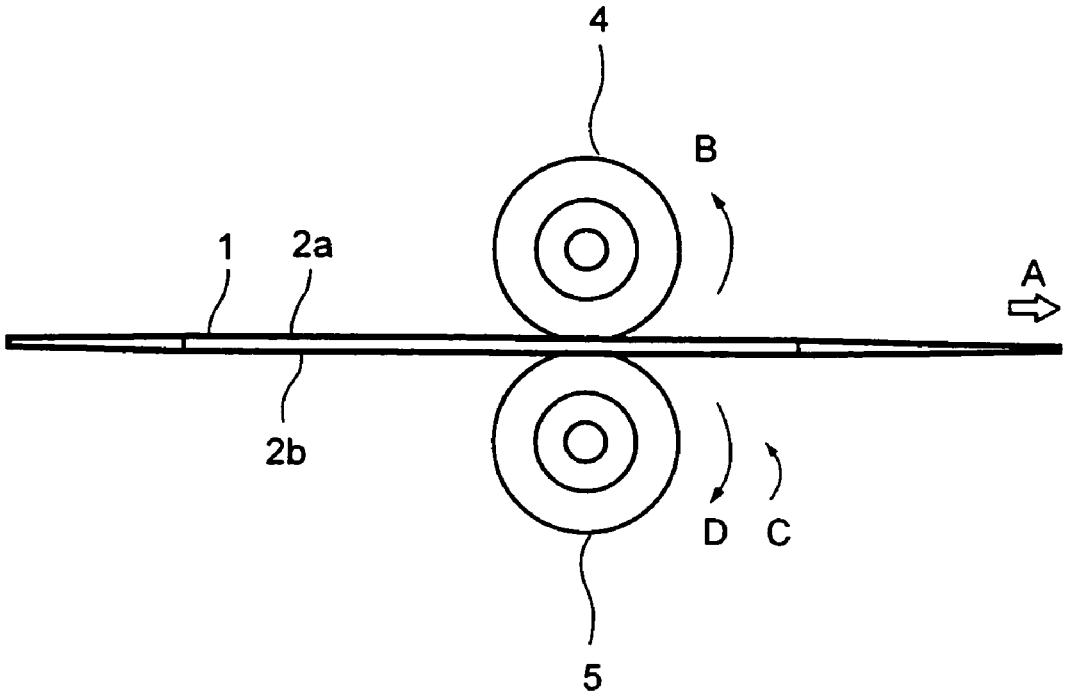
FIG. 2A is a schematic side view of the overlapped-sheet detection apparatus to explain its operation when one sheet is conveyed.

FIG. 2A schematically shows that one sheet 1 is held between, and sent in direction A by forwarding roller 4 and shifting roller 5 of the overlapped-sheet detection apparatus shown in FIGS. 1A and 1B. Forwarding roller 4 rotates in direction B so that shifting roller 5 follows to rotate in direction D. Forwarding and shifting rollers 4 and 5 hold and convey sheet 1 in direction A. In this case, since a gap defined between rollers 4 and 5 is small, a depression force exerted by roller 5 is weak, and the shifting torque in rotational direction C is so small, rollers 4 and 5 facilitate the smooth conveyance of sheet 1.

Figure 2B:
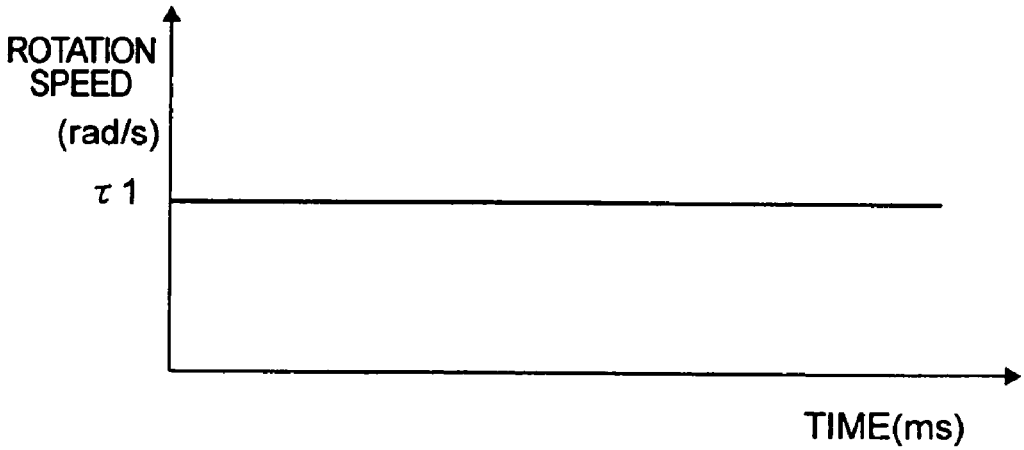
FIG. 2B is a rotation speed characteristic diagram of a shifting roller of the overlapped-sheet detection apparatus when one sheet is conveyed

FIG. 2B shows a rotation speed of shifting roller 5 in the case that one sheet 1 passes through contact portions pressed by rollers 4 and 5. Specifically, it is the rotation speed of shifting roller 5 measured by the encoder built in torque motor 6 for driving roller 5. Measured changes in rotation speed are substantially within a tolerable range of constant value "τl" in the case of one sheet as set forth above.

Next, operations of overlapped sheets will be explained with reference to FIGS. 3A and 3B. Here, FIG. 3A schematically shows that rollers 4 and 5 hold and convey two partially overlapped upper and lower sheets 1*a* and 1*b*. In this case, sheet 1 a is conveyed in direction A while sheet 1*b* in contact with roller 5 is controlled by shifting roller 5 driven by the torque energized in rotation direction C as follows.

Namely, when overlapped sheets 1*a* and 1*b* are conveyed, a gap defined between roller 4 and 5 is larger so that a depression force by roller 5 against roller 4 becomes greater. Thus, when a front end portion of overlapped sheet 1*b* reaches the contact portions pressed by rollers 4 and 5, the rotation speed of roller 5 in direction D begins to reduce by the torque rotating in direction C. Further, when the gap becomes more than a predetermined value, roller 5 rotates in direction C. As a result, sheet 1*b* in contact with roller 5 is shifted by roller 5 in the reverse direction of that of A.

FIG. 3B shows rotation speeds of shifting roller 5 with respect to time in the case that forwarding and shifting rollers 4 and 5 hold and convey two partially overlapped sheets 1*a* and 1*b*. As described above, however, until time "T1" only one sheet 1*a* is held between, and conveyed by, forwarding and shifting roller 4 and 5 and roller 5 rotates in direction D together with roller 5 at the speed of "τ1".

Next, when the edge portion of overlapped sheets 1*a* and 1*b* reach the contact portions of rollers 4 and 5, shifting roller 5 begins reducing the rotation speed in direction D. Subsequently, after the rotation speed rapidly reduces to zero, the rotation direction of shifting roller 5 is reversed to direction C. Period of time "t1" between "T1" and "T2" shown in FIG. 3 is the one during which the overlapped sheets 1*a* and 1*b* pass through the contact portions pressed by rollers 4 and 5.

A shifting distance defined between sheets 1*a* and 1*b* is set depending on the reversed rotation speed "−τ2"; the reversed rotation speed "−τ2" becomes larger as the shifting distance increases.

In order to achieve the necessary shifting of sheets, a friction coefficient between forwarding roller 4 and sheet 1*a* and that between shifting roller 5 and sheet 1*b* need to be satisfied with the following equations:

$$\mu r1>\mu p \quad (3)$$

$$\mu r2>up \quad (3)$$

μr1: a friction coefficient between forwarding roller 4 and sheet 1*a;*

μr2: a friction coefficient between shifting roller 5 and sheet 1*b;* and μp: friction coefficient between sheets 1*a* and 1*b*.

Further, a method of detecting overlapped sheets will be explained with reference to FIGS. 3B and 3C. Rotation-speed threshold level "τth" is set in consideration of possible conveying errors of sheets 1 as follows:

$$\tau th=\tau 1\times.0.9 \quad (4)$$

If the rotation speed of shifting roller 5 is not more than rotation-speed threshold level "τ th" during a period of time "t2", the occurrence of overlapped sheets is determined by the following equation:

$$t2\geqq td \quad (5)$$

where "td": overlapping-time identification period.

As set forth above, the overlapped-sheet detection apparatus of the first embodiment can securely shift overlapped sheets 1*a* and 1*b*. The overlapped sheets can be readily detected by comparing a rotation speed of shifting roller 5 with a predetermined value.

Second Embodiment

An overlapped sheets detection apparatus of the second embodiment in accordance with the present invention will be described below with reference to FIG. 4.

FIGS. 4A-4D show operations of the overlapped sheets detection apparatus in the case of two overlapped sheets 1*a* and 1*b* which are similar to, but separate from, those shown in FIG. 3B. Until time "T1", forwarding and shifting rollers 4 and 5 hold and convey only one sheet 1*a* and roller 5 rotates together with roller 4 at speed "τ1".

Next, when the front edge portion of overlapped sheets 1*a* and 1*b* reach the contact portions of rollers 4 and 5, shifting roller 5 begins reducing the rotation speed in direction D. The overlapped sheets detection apparatus detects timing "T11" at which the rotation speed becomes the threshold level "τ th". In other words, the overlapped sheets are detected at timing "T11" as shown in FIG. 4B.

Figure 4A:
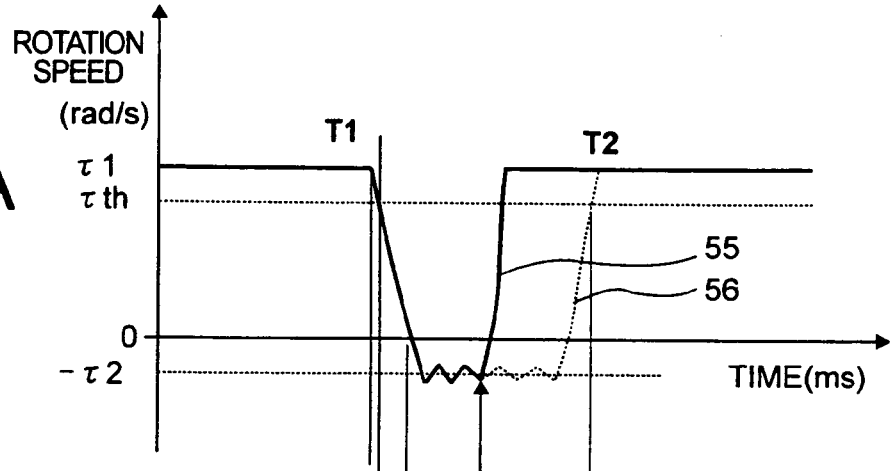
FIG. 4A is a rotation speed characteristic diagram of a shifting roller when sheets are overlapped in an overlapped-sheet detection apparatus according to the second embodiment of the present invention.
Figure 4B:
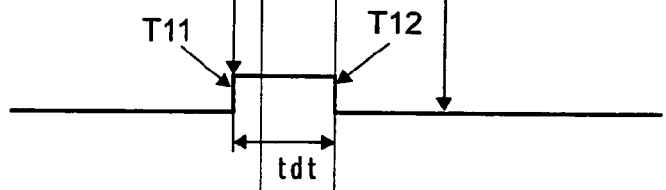
FIG. 4B is a detection timing chart of the overlapped sheets.
Figure 4C:
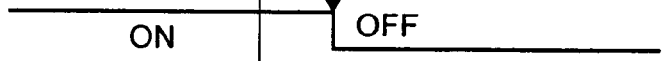
FIGS. 4C and 4D are shifting torque timing and shift charts, respectively.

Subsequently, if the overlapped sheets detection apparatus continuously detects the overlapped sheets 1*a* and 1*b* for a predetermined period of time "tdt", the driving torque applied to rotate shifting roller 5 in direction C shown in FIG. 3A is released at timing "T12" as shown in FIG. 4C.

Shifting roller 5 released from the torque tries to follow the rotation of forwarding roller 4 so that the rotation speed 55 of shifting roller 5 rapidly rises as shown in FIG. 4A. It eventually becomes the same speed as that of forwarding roller 4. In this way, forwarding and shifting roller 4 and 5 rotate together at the same speed again. Rotation speed 56 shows the rotation speed of shifting roller 5 in the case that no torque is released from shifting roller 5.

Figure 4D:
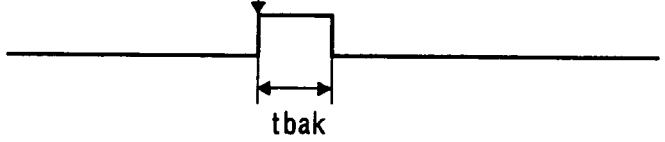

As shown in FIG. 4D, according to the second embodiment of the present invention, shifting period of time or shifting distance "tbak" can be set arbitrarily by the control of shifting torque applied to shifting roller 5.

Rotation speeds of shifting roller 5 change depending on whether one sheet or overlapped sheets are to be conveyed. When sheets are overlapped, the sheets are shifted during shifting period of time "tbak". As a result, a total length of the overlapped sheets 1*a* and 1*b* becomes longer than that of the sheets before such shifting is conducted. Thus, the overlapped sheets can be securely detected and shifted. Further, the overlapped sheets can be detected by the comparison of rotation speeds of shifting roller 5 with a predetermined value.

Third Embodiment

Figure 5A:
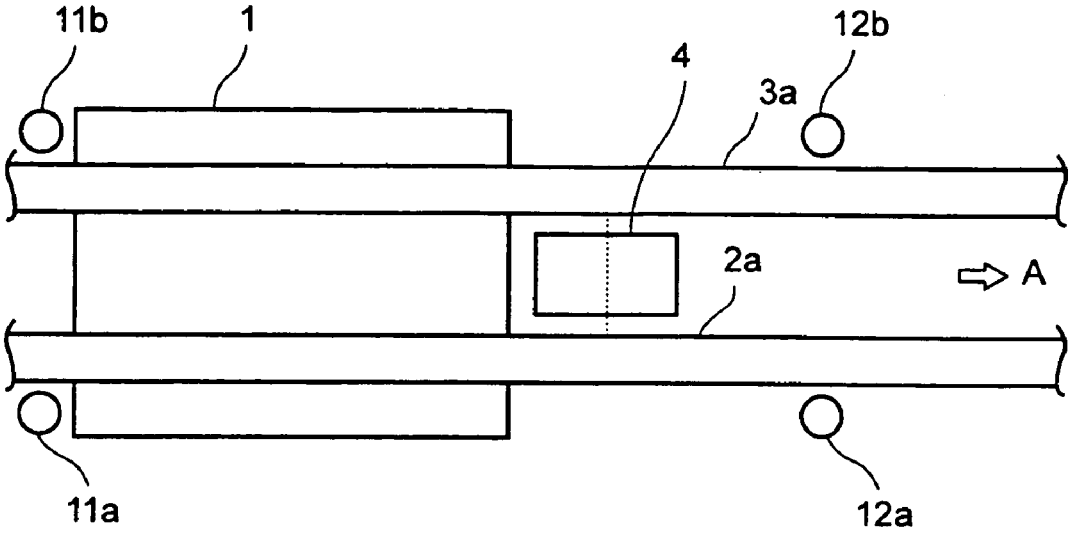
FIGS. 5A and 5B are schematic plan and side views of an overlapped-sheet detection apparatus according to the third embodiment of the present invention, respectively.
Figure 5B:
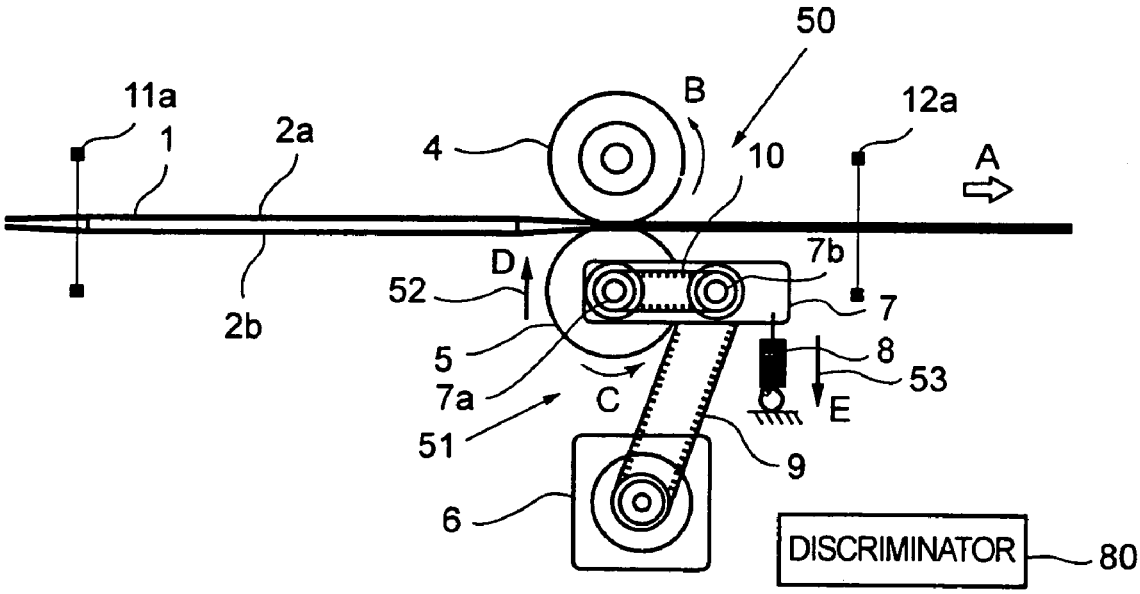

An overlapped-sheet detection apparatus of the third embodiment in accordance with the present invention will be described below with reference to FIGS. 5-7. FIGS. 5A and 5B are schematic plan and side views of the overlapped-sheet detection apparatus.

The overlapped-sheet detection apparatus is further provided with entrance sensors 11*a* and 1*b* and exit sensors 12*a* and 12*b*. The structure of the overlapped-sheet detection apparatus of this embodiment is substantially the same except those sensors as that of the overlapped-sheet detection apparatus of the first embodiment. Thus, their same or similar reference numerals indicate the same or equivalent components and explanations about them are omitted.

Figure 6A:
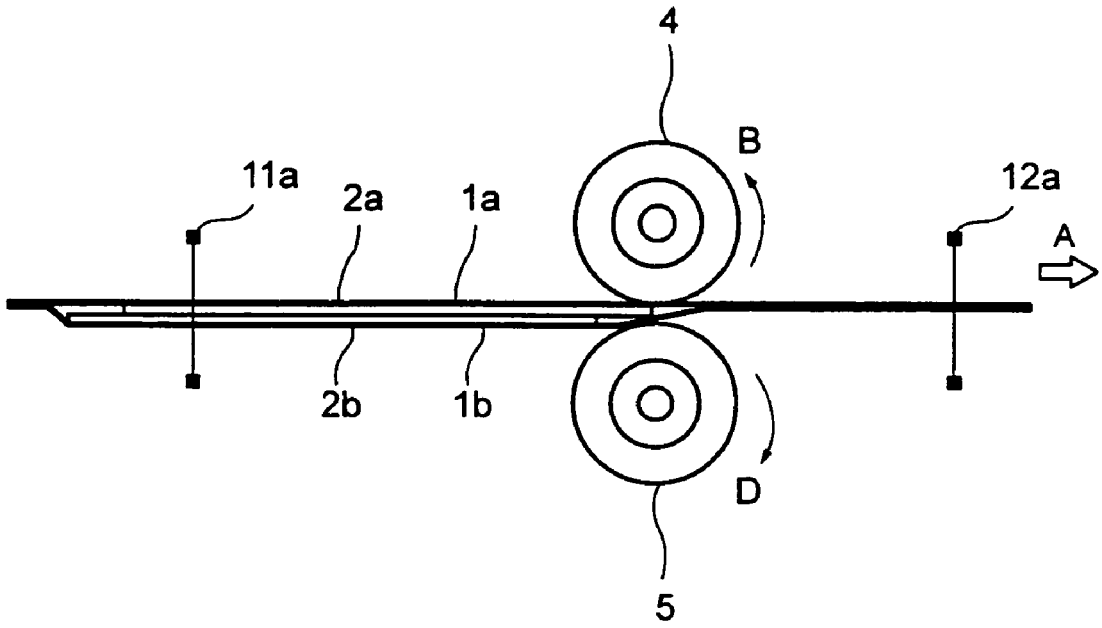
FIG. 6A is a schematic side view of the overlapped-sheet detection apparatus shown in FIGS. 5A and 5B when overlapped sheets are conveyed.

Operations of the overlapped-sheet detection apparatus of the third embodiment will be explained below with reference to FIGS. 6 and 7. FIG. 6A shows that sheets 1*a*and 1*b* are conveyed in direction A and reach the contact portions pressed by forwarding and shifting rollers. 4 and 5 of overlapped-sheet detection unit 50.

Figure 6B:
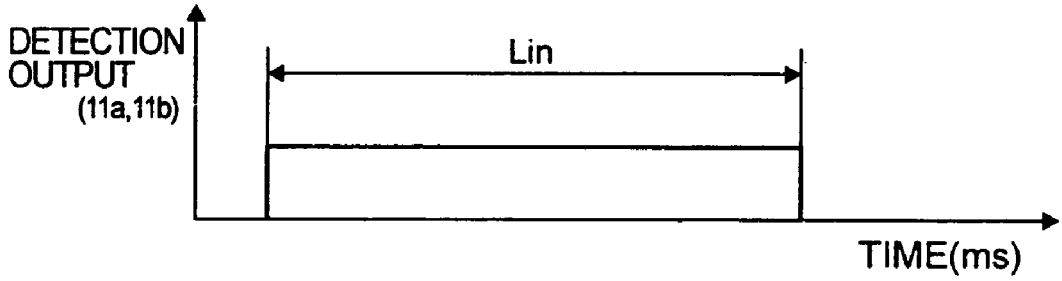
FIG. 6B is a detection timing chart of sheet-length in the overlapped-sheet detection apparatus shown in FIG. 6A.

When sheets 1*a* and 1*b* pass though entrance sensors 11*a* and 11*b*, entrance sensors 11*a* and 11*b* generate passage time signals of sheets 1*a* and 1*b* and send them to discriminator 80. Discriminator 80 measures length "Lin" of sheets 1*a* and 1*b* in the conveying direction based on the passage time signals as shown in FIG. 6B.

Shifting roller 5 is not provided with shifting torque or is provided with sufficiently smaller torque than that shown in FIG. 1B. Thus, shifting roller 5 follows to rotate with forwarding roller 4, rotating in direction D.

Figure 7A:
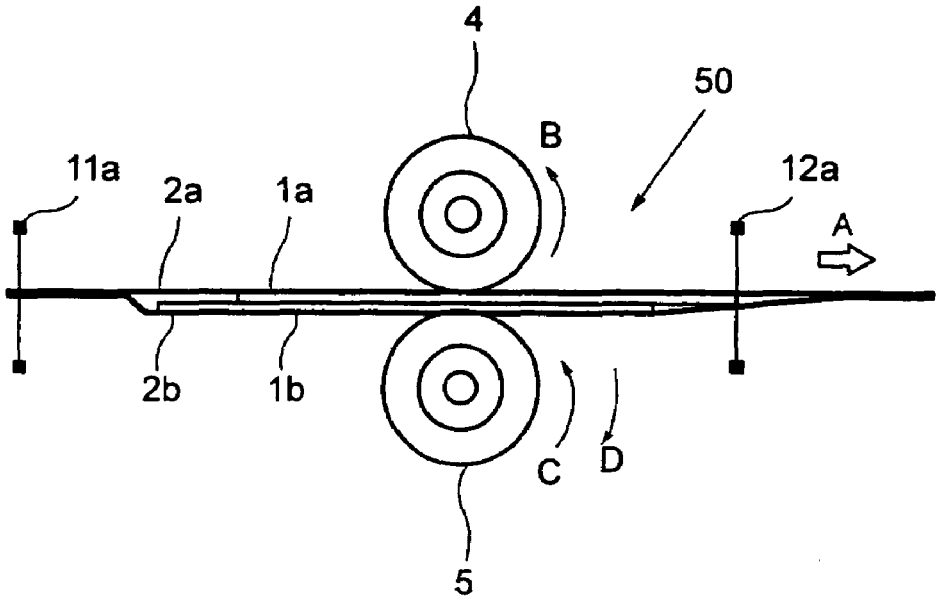
FIG. 7A is another schematic side view of the overlapped-sheet detection apparatus shown in FIGS. 5A and 5B when overlapped sheets are conveyed.

FIG. 7A shows that sheets 1*a* and 1*b* are conveyed in direction A and reach exit sensors 12*a* and 12*b*. When exit sensors 12*a* and 12*b* detect a front edge portion of sheets 1*a* and 1*b*, shifting roller 5 is provided with shifting torque. Thus, sheet 1*b*, in contact with shifting roller 5, is shifted by shifting roller 5 in a reverse direction of conveying direction A.

Figure 7B:
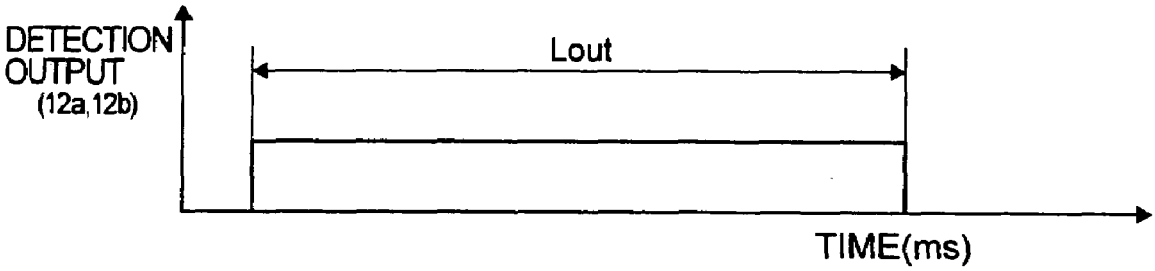
FIG. 7B is a detection timing chart of sheet-length in the overlapped-sheet detection apparatus shown in FIG. 7A.

Further, when sheets 1*a* and 1*b* pass though exit sensors 12*a* and 12*b*, exit sensors 12*a* and 12*b* measure passage time signals of sheets 1*a* and 1*b* which have been already shifted and correspond to shifted length "Lout" of sheets 1*a* and 1*b*. FIG. 7B shows the shifted length of sheets 1*a* and 1*b* measured in the conveying direction.

Next discriminator 80 compares shifted length "Lout" of sheets 1*a* and 1*b* measured by exit sensors 12*a* and 12*b* with length "Lin" of sheets 1*a* and 1*b* measured by entrance sensors 11*a* and 11*b* and calculates length difference "ΔL" between them. If length difference "ΔL" is not less than a predetermined value, discriminator 80 detects the occurrence of overlapped sheets. The operations are expressed by the following equations:

$$\Delta L = L\text{out} - L\text{in} \tag{6}$$

$$\Delta L \geqq Ld \tag{7}$$

where "Lout" is a length of sheets 1*a* and 1*b* in the conveying direction measured by exit sensors 12*a* and 12*b;*

"Lin" is a length of sheets 1*a* and 1*b* in the conveying direction measured by entrance sensors 11*a* and 11*b;*

"ΔL" is a length difference between lengths "Lout" and "Lin" of sheets 1*a* and 1*b;* and "Ld" is a reference length for the judgment of overlapped sheets.

As described above, the third embodiment additionally includes entrance sensors 11*a* and 11*b* and exit sensors 12*a* and 12*b* provided behind and in front of forwarding roller 4 with respect to conveying direction A, respectively. First, entrance sensors 11*a* and 11*b* measure a length of sheets 1*a* and 1*b*. After the front edge of sheets 1*a* and 1*b* reaches exit sensors 12*a* and 12*b*, shifting roller 5 shifts sheet 1*b* for a predetermined period of time. Subsequently exit sensors 12*a* and 12*b* measure such a shifted length of sheets 1*a* and 1*b*. Finally, discriminator 80 calculates a length difference between the first measured and shifted lengths so that discriminator 80 can certainly detect an overlapped-sheet situation if the length difference is not less than a predetermined value.

Fourth Embodiment

Figure 8:
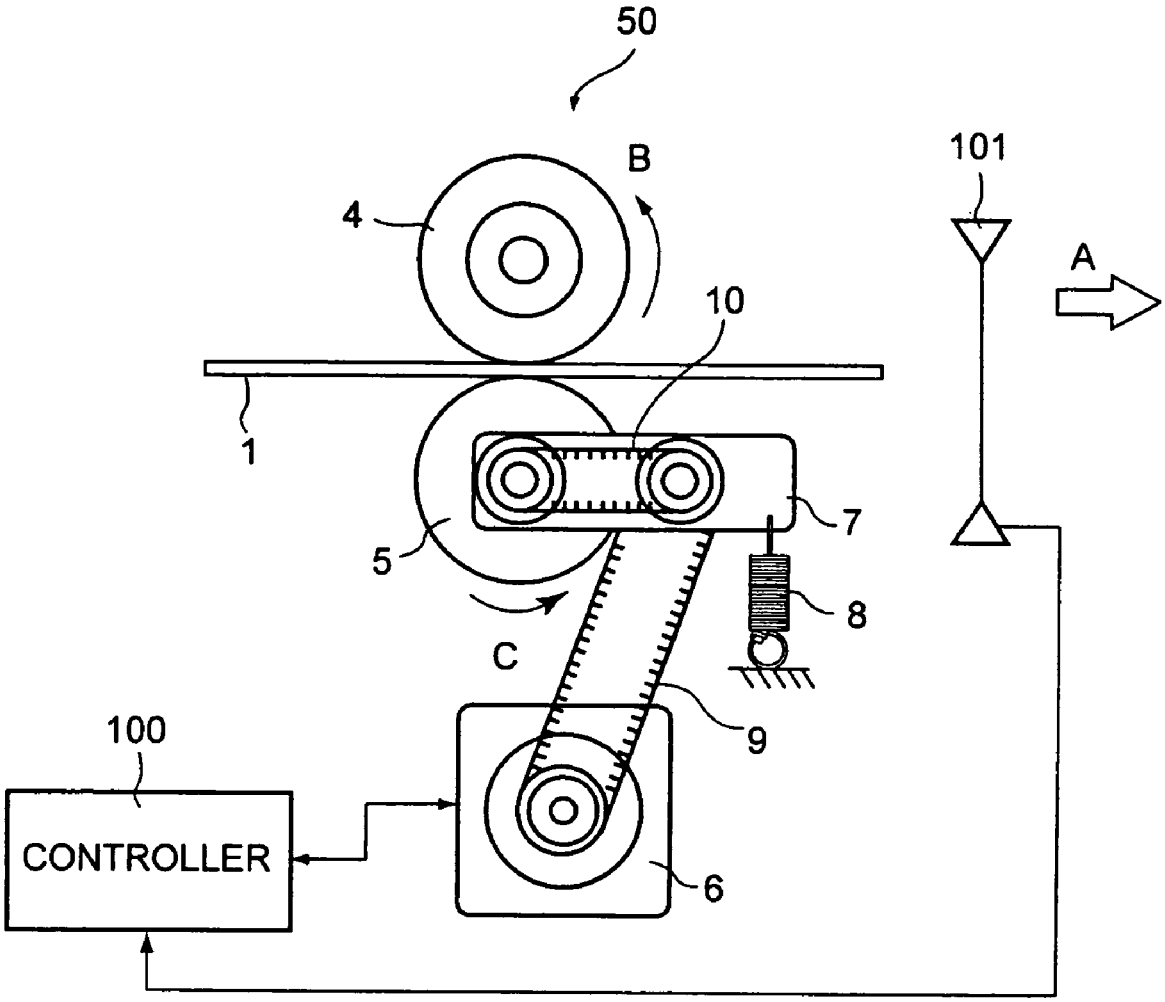
FIG. 8 is a schematic side view of an overlapped-sheet detection apparatus according to the fourth embodiment of the present invention.

An overlapped-sheet detection apparatus of the fourth embodiment in accordance with the present invention will be described below with reference to FIG. 8. As shown in FIG. 8, the overlapped-sheet detection apparatus is further provided with controller 100 (including rotation detection means, judgment means and control means), in place of discriminator 80 in the previous embodiments, to control torque control motor 6 and sensor 101 (passage detection means) to detect passage of sheets 1. The structure of the overlapped-sheet detection apparatus of this embodiment is substantially the same, except controller 100 and sensor 101, as that of the overlapped-sheet detection apparatus shown in FIG. 1. Thus, their same or similar reference numerals indicate the same or equivalent components and explanations about them are omitted.

Controller 100 is connected to torque control motor 6 through a control circuit, not shown. Controller 100 can obtain rotation information of shifting roller 5 detected by an encoder built in torque control motor 6, determine overlapped sheets as in the first through third embodiments, and supply control instructions based on such rotation information to torque control motor 6. Controller 100 is connected to sensor 101 through a driving amplifier, also not shown, so that controller 100 can receive an output from sensor 101. Conveying belts 2 and 3 are provided in this embodiment but are not shown in FIG. 8.

Figure 9:
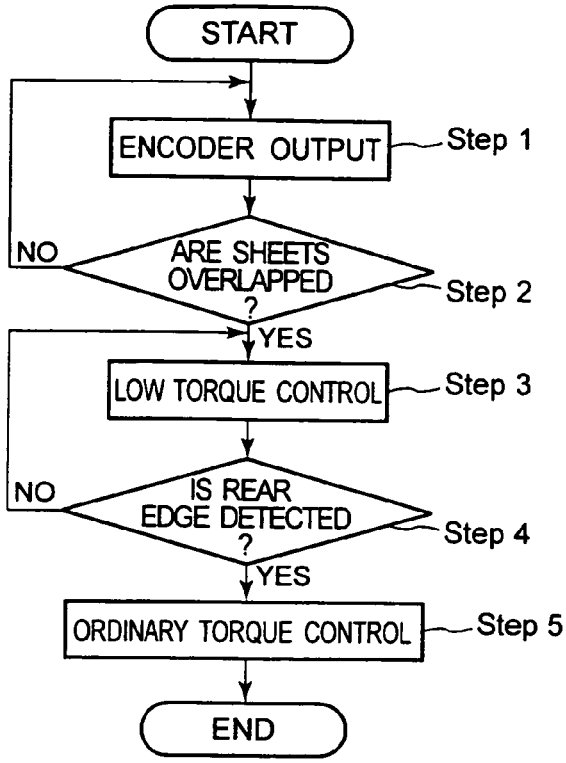
FIG. 9 is a flow chart of the overlapped-sheet detection apparatus shown in FIG. 8.

Operations of the overlapped-sheet detection apparatus of the fourth embodiment will be explained below with reference to a flow chart shown in FIG. 9.

While sheets are being conveyed, controller 100 continuously monitors the output from the encoder built in torque control motor 6 and detects rotation states of shifting roller 5 (Step 1). When overlapped sheets are not conveyed (e.g., one sheet is conveyed as shown in FIG. 8), the output of the encoder is such a constant value "τl" as shown in FIG. 2B.

Controller 100 judges in accordance with the output of the encoder detected in Step 1 whether a rotation speed of shifting roller 5 becomes slow or not (Step 2). When controller 100 judges in Step 2 that the rotation speed of shifting roller 5 is slow, controller 100 detects the occurrence of overlapped sheets (Step 2: YES) and controls torque control motor to make shifting torque lower than in an ordinary state (Step 3). When controller 100 detects, however, the overlapped sheets, controller 100 may control torque control motor 6 to make shifting torque nil. As a result, the sheets are shifted less.

Shifting roller 5 is supplied with appropriate torque to shift overlapped sheets properly in the ordinary state. When overlapped sheets occur, and if the torque is continuously supplied to shifting roller 5, the sheets are shifted more than necessary and as such, a conveying interval between the current and following sheets becomes too short. If such a conveying interval were less than a predetermined value, both current and following sheets should be rejected. In order to make the rejection of the sheets less possible, however, this embodiment is configured to set the shift as small as possible.

After the completion of Step 3, controller 100 monitors the output of sensor 101 to check if the rear edge portion of the overlapped sheets pass through sensor 101 (Step 4). When sensor 101 detects the passage of the sheets (Step 4: YES), controller 100 controls torque control motor 6 to return the reduced or null torque made in Step 3 to the ordinary one (Step 5). In other words, controller 100 controls torque control motor 6 to keep the shifting torque provided to shifting roller 5 low until sensor 101 detects the passage of the rear edge portion of the sheets As described above, the overlapped-sheet detection apparatus according to this embodiment can certainly and easily detect overlapped sheets substantially in the same manner as those of the first through third embodiments can. Further, since the overlapped-sheet detection apparatus of this embodiment shifts a sheet or sheets as little as possible for the detection of overlapped sheets, it makes less possible a conveying interval of the sheets being too short, makes a rejection rate of the sheets resulting from a short conveying interval lower, and improves an operation rate of the apparatus.

Fifth Embodiment

Figure 10:
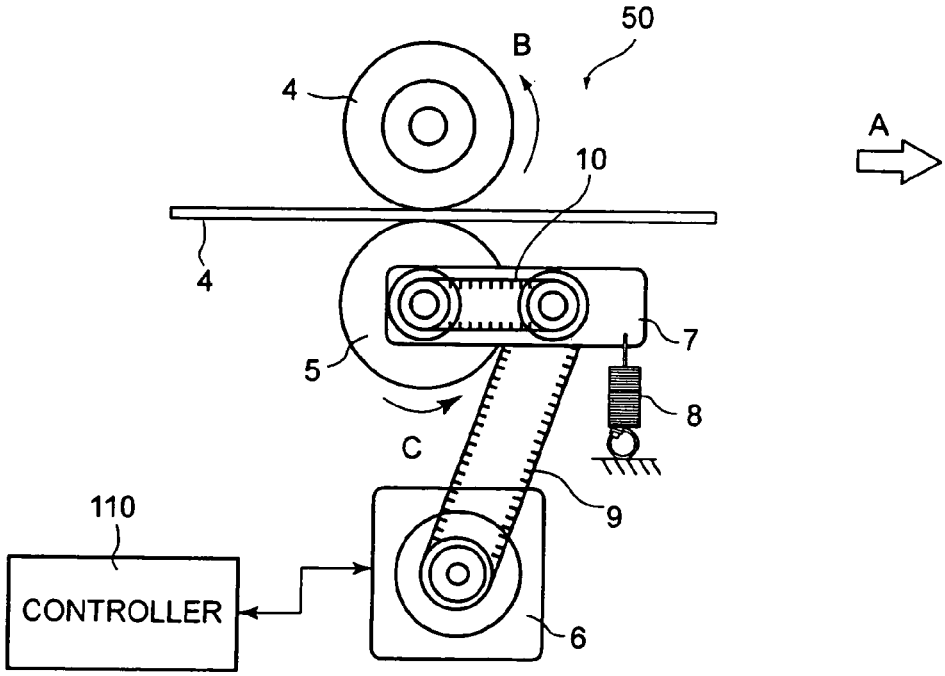
FIG. 10 is a schematic side view of an overlapped-sheet detection apparatus according to the fifth embodiment of the present invention.

FIG. 10 shows a schematic side view of an overlapped-sheet detection apparatus in accordance with the fifth embodiment of the present invention. The overlapped-sheet detection apparatus is provided with controller 110 in place of controller 100 in the fourth embodiment. Controller 110 additionally has means for measuring shift of sheets in response to output from the encoder. The overlapped-sheet detection apparatus is substantially the same as that of fourth embodiment except controller 110.

Figure 11:
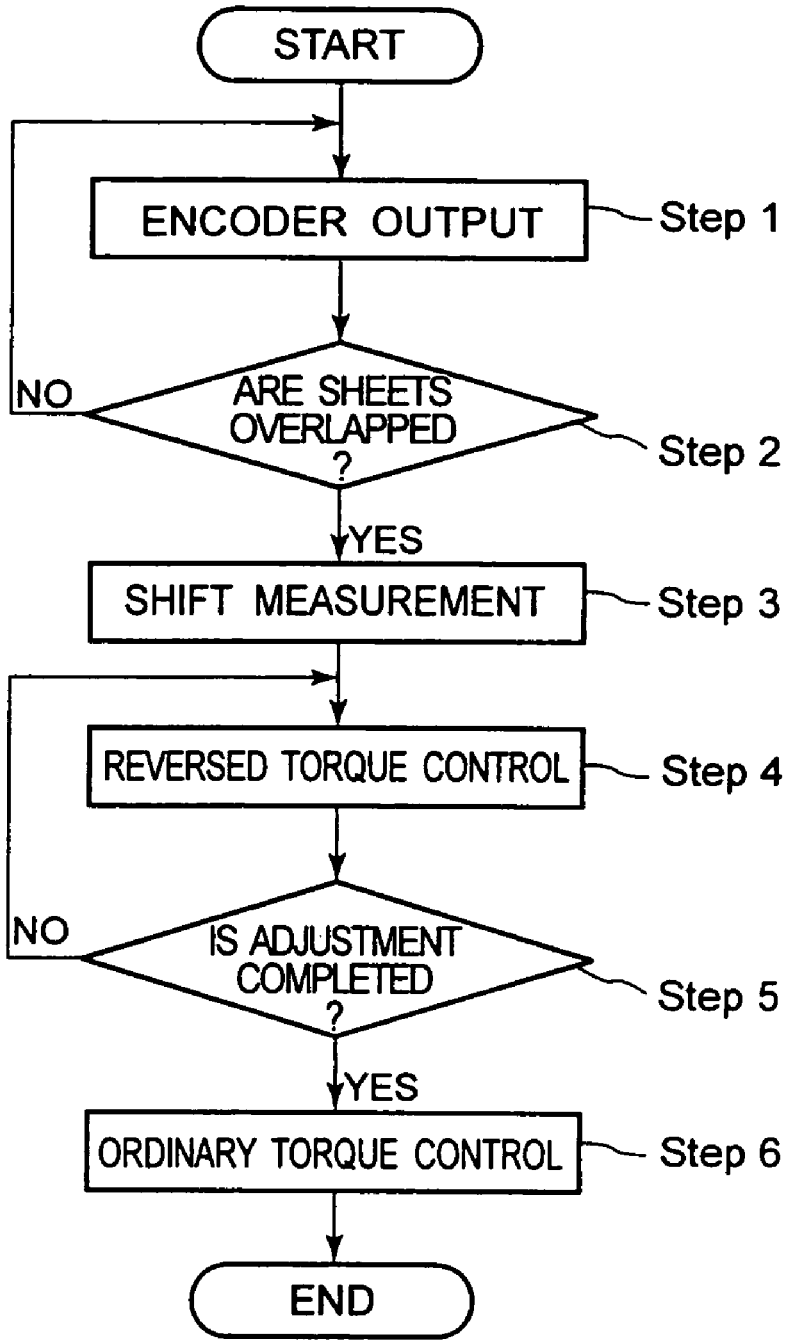
FIG. 11 is a flow chart of the overlapped-sheet detection apparatus shown in FIG. 10.

Operations of the overlapped-sheet detection apparatus of the fifth embodiment will be explained below with reference to a flow chart shown in FIG. 11.

While sheets are being conveyed, controller 100 continuously monitors the output from the encoder built in torque control motor 6 and detects rotation states of shifting roller 5 (Step 1). When overlapped sheets are not conveyed (e.g., one sheet is conveyed as shown in FIG. 10), the output of the encoder is such a constant value "τ1" as shown in FIG. 2B.

Controller 110 judges in accordance with the output of the encoder detected in Step 1 whether a rotation speed of shifting roller 5 becomes slow or not (Step 2). When controller 110 judges in Step 2 that the rotation speed of shifting roller 5 is slow, controller 110 detects the occurrence of overlapped sheets (Step 2: YES) and measures shift of the sheets 1 shifted by shifting roller 5 (Step 3). This shift can be measured in terms of rotation speeds of shifting roller 5 and a period of time during which rotation speeds of shifting roller 5 vary.

Subsequently, controller 110 controls torque control motor 6 to supply shifting roller 5 with returning torque that is reversed in direction to the ordinary shifting torque with which torque control motor 6 ordinarily supplies shifting roller 5 (Step 4). In other words, controller 110 returns overlapped sheets in a reverse direction of the conveying one until substantial cancellation is performed for the shift (Step 5: YES) with which shifting roller 5 supplied the overlapped sheets during a period of time from the detection of the overlapped sheets to the reverse torque control in Step 4. Thus, the original length of the sheets is substantially restored from the length shifted along the conveying direction for the detection of the overlapped state.

After the operations in Steps 4 and 5, i.e., the restoration to the original length of the overlapped sheets from the shifted one (Step 5: YES), controller 110 controls torque control motor 6 to supply shifting roller 5 with the ordinary shifting torque (Step 6).

As described above, the overlapped-sheet detection apparatus according to the fifth embodiment can certainly and easily detect overlapped sheets substantially in the same manner as those of the first through third embodiments can. Further, since the overlapped-sheet detection apparatus of this embodiment substantially returns the shifted sheets to the original state, the overlapped-sheet detection apparatus can keep a gap defined between the current and following sheets adequate, can avoid an improperly short interval and can further improve an operation rate of the apparatus. That is, when the overlapped sheets are shifted from each other and a conveying interval defined between the current and following sheets becomes shorter than a predetermined value, both sheets must be rejected. The overlapped-sheet detection apparatus of the fifth embodiment, however, returns the overlapped sheets to the original state so that it does the current sheets only and needs not reject the following sheets.

Sixth Embodiment

Figure 12:
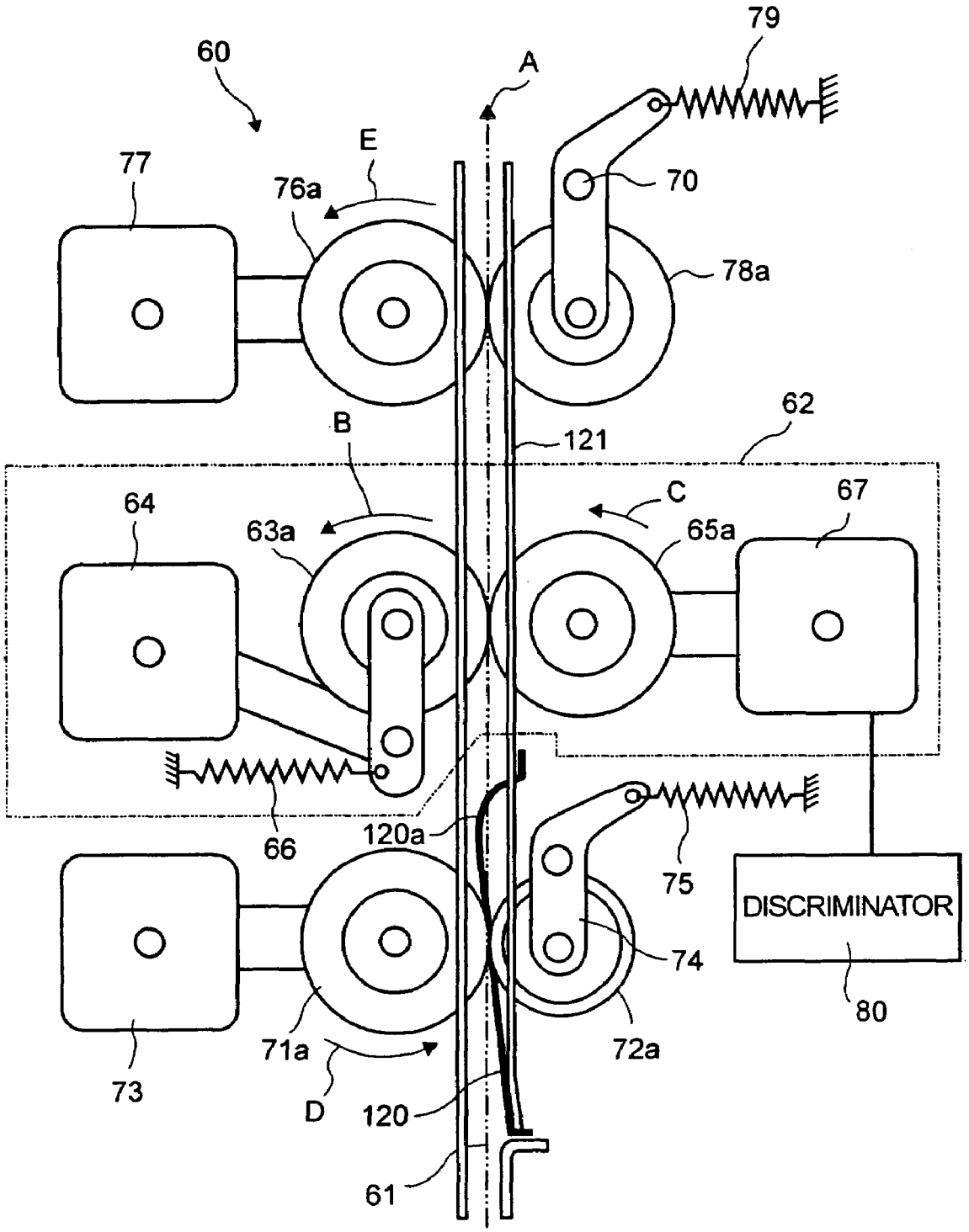
FIG. 12 is a schematic side view of an overlapped-sheet detection apparatus according to the sixth embodiment of the present invention.
Figure 13:
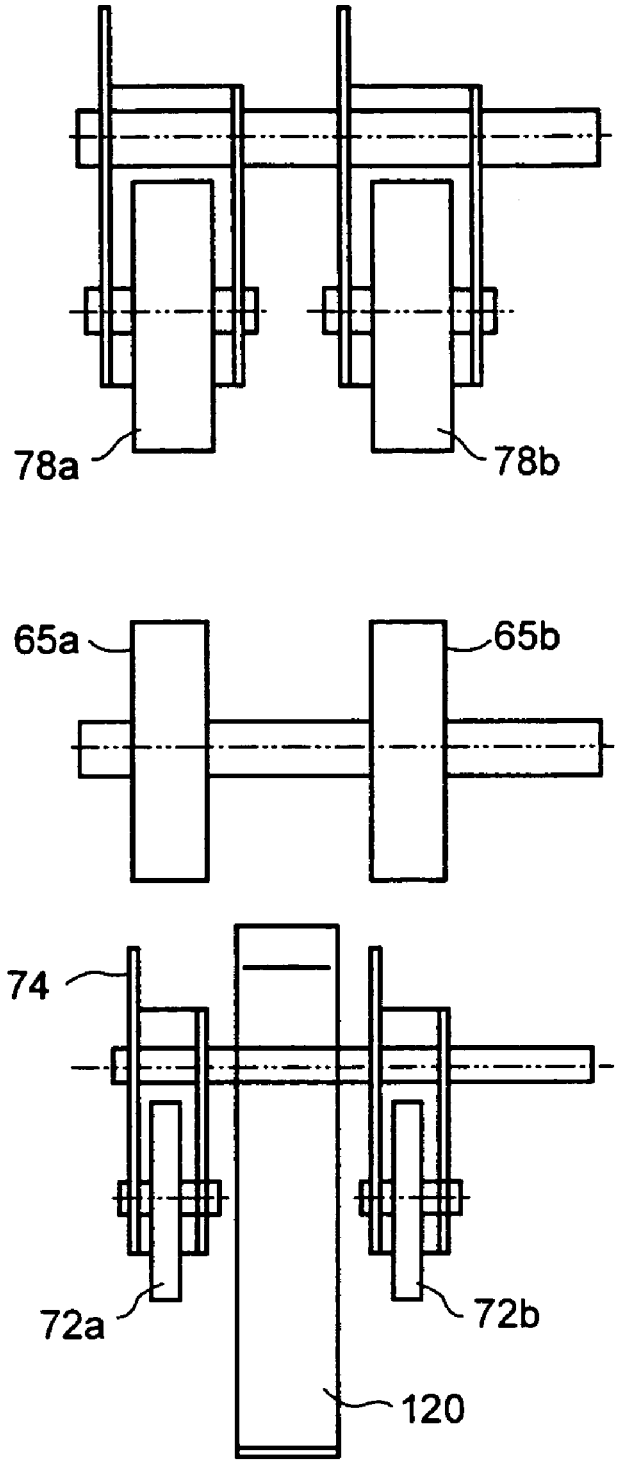
FIG. 13 is a plan view of certain components of the overlapped-sheet detection apparatus shown in FIG. 12.

Next, overlapped-sheet detection apparatus 60 in accordance with the sixth embodiment of the present invention will be explained below with reference to FIGS. 12 and 13. Schematic plan and side views of overlapped-sheet detection apparatus 60 are shown in FIG. 12 and 13, respectively. Overlapped-sheet detection apparatus 60 is provided with overlapped-sheet detection unit 62 that is substantially the same in function as that of unit 50 of the first through third embodiments. Overlapped-sheet detection unit 62 consists of the first forwarding roller 63*a;* driving motor 64, shifting roller 65*a,* spring 66, and torque control motor (torque supplying means) 67. Forwarding and shifting rollers 63*a* and 65*a* are provided on left and right sides of conveying path 61, respectively. Spring 66 pinch-presses forwarding roller 63*a* against shifting roller 65*a*. Driving motor 64 rotates forwarding roller 63*a* in direction B while torque control motor 67 supplies shifting torque to shifting roller 65*a*. In short, overlapped-sheet detection unit 62 is substantially the same in structure as overlapped-sheet detection unit 50 of the previous embodiments except that spring 66 does not press shifting roller 65*a* but forwarding roller 63*a*. Torque control motor 67 includes an encoder to detect a rotation speed of shifting roller 65*a* as rotation detection means. The encoder is connected to discrimination means or discriminator 80 to judge overlapped sheets. The rotation speed detected by the encoder and overlapped state of the sheets is judged by discriminator 80 in overlapped-sheet detection unit 62 substantially in the same manner as those in overlapped-sheet detection unit 50.

As shown in FIG. 12, the second forwarding roller 71*a* made of rubber is rotationally provided opposite to pinch roller 72*a* made of plastic resin along conveying path 61 at the lower entrance portion of overlapped-sheet detection apparatus 60. The second forwarding roller 71*a* is provided on the same side as the first forwarding roller with respect to conveying path 61. Driving motor 73 rotates the second forwarding roller 71*a* in direction D at the same circumference speed as the first forwarding roller 63*a*. Pinch roller 72*a* is rotationally provided at an edge of arm 74 biased by spring 75. Pinch roller 72*a* presses the second forwarding roller 71*a* through conveying path 61.

Conveying roller 76*a* and pinch roller 78*a* are provided at the upper exit portion of overlapped-sheet detection apparatus 60. Conveying roller 76*a* receives sheets 1 from overlapped-sheet detection unit 62 and sends them out to the next stage. Pinch roller 78*a* is pinch-pressed against conveying roller 76*a* through conveying path 61. Driving motor 77 rotates conveying roller 76*a* in direction E at the same circumference speed as forwarding rollers 63*a* and 71*a*. Pinch roller 78*a* is biased by spring 79. The rollers shown in FIG. 12 each are actually paired ones but only one of each of the paired rollers are shown as 63*a*, 65*a*, 71*a*, 72*a*, 76*a* and 78*a*. FIG. 13 illustratively shows a plan view of such paired rollers 65*a* and 65*b*, 72*a* and 72*b*, and 78*a* and 78*b* by way of examples (provided on the right side of conveying path 61 in FIG. 12).

Since rollers 71*a* and 72*a* are provided on the lower entrance side of overlapped-sheet detection unit 62 to send sheets 1 to rollers 63*a* and 65*a*, a distance defined between the axes of the first and second rollers 63*a* and 71*a* along the conveying direction is shorter than the shortest one of the sheets to be processed. Namely, rollers 63*a* and 65*a* are capable of pinching at even the shortest sheet forwarded by rollers 71*a* and 72*a*. Similarly, although rollers 76*a* and 78*a* are provided on the upper exit side of overlapped-sheet detection unit 62 to receive sheets 1 from rollers 63*a* and 65*a*, a distance defined between the axes of rollers 63*a* and 76*a* along the conveying direction is also shorter than the shortest one of the sheets to be processed.

In this connection, when overlapped sheets are detected in over-lapped sheet detection unit 62, the sheets are possibly shifted in the reverse direction and returned to rollers 71*a* and 72*a* at the lower entrance portion of over-lapped sheet detection apparatus 60. In this case, if rollers 71*a* and 72*a* are too strong in pinch-pressure, rollers 71*a* and 72*a* cannot make such sheets shifted in reverse slide and, as a result, the sheets are jammed or torn. Thus, the pinch pressure of roller 72*a* is set to be as weak as possible.

As a result, when relatively thick sheets 1 are sent to rollers 71*a* and 72*a*, pinch roller 72*a* easily jumps up from conveying path 61, and rollers 71*a* and 72*a* lose their conveying force and waste time. The conveying speed of sheets 1 becomes slower and the conveying interval between the current and following sheets shortens.

In order for this embodiment to overcome such troubles, spring guide plate 120 is provided to press sheets against the second forwarding roller 71*a* in addition to pinch roller 72*a*. Guide plate 120 is made of a curved plastic-resin plate member. As shown in FIG. 12, guide plate 120 is fixed to conveying guide 121 on the right side of conveying path 61 and, as shown in FIG. 13, guide plate 120 is disposed between rollers 72*a* and 72*b*.

More specifically, guide plate 120 extends along conveying direction A of sheets 1, the lower end of guide plate 120 is screwed to conveying guide 121 while the upper end portion of guide plate 120 is bent and the upper end is engaged with conveying guide 121. The upper end portion of guide plate 120 can take in a direction separate from conveying path 61. Further, guide plate 120 is not easily detached from conveying guide 121 and regulated to move to the left side shown in FIG. 12.

Further, guide plate 120 has convexly curved portion 120*a* slightly projecting over conveying path 61 towards the second roller 71*a*. Convexly curved portion 120*a* is provided on the side of rollers 63*a* and 65*a* but apart from the position where rollers 71*a* and 72*a* pinch at sheets. The depressing position of sheets 1 by roller 72*a* is slightly shifted from that of sheets by guide plate 120. Thus, no strong depression is applied to sheets at the same conveying position but weak depression can be applied to sheets at different conveying positions.

In addition, even in such a case that relatively thick sheets are conveyed and the sheets make pinch roller 72*a* jump up from conveying path 61, as described above, convexly curved portion 120*a* depresses the sheets 1 against the second forwarding roller 71*a* so that the sheets 1 can be sufficiently supplied with conveying power. In this case, particularly, since guide plate 120 is made of plastic resin, shifted sheets 1 due to the overlapped state slide on guide plate 120 and are allowed to return to the reverse direction.

According to this embodiment, even when the collision of sheets 1 against pinch roller 72*a* makes roller 71*a* jump, convexly curved portion 120*a* of guide plate 120 can depress the sheets against the second forwarding roller 71*a* to prevent reduction of the conveying force of forwarding roller 71*a*. This can also avoid a short conveying interval between the current and following sheets, reject less sheets, and improve an operation rate. The second forwarding roller 71*a* is particularly made of plastic resin, shifted sheets 1 due to the overlapped state slide on guide plate 120 and are allowed to return to the reverse direction so that the sheets can avoid being jammed or torn.

Figure 14:
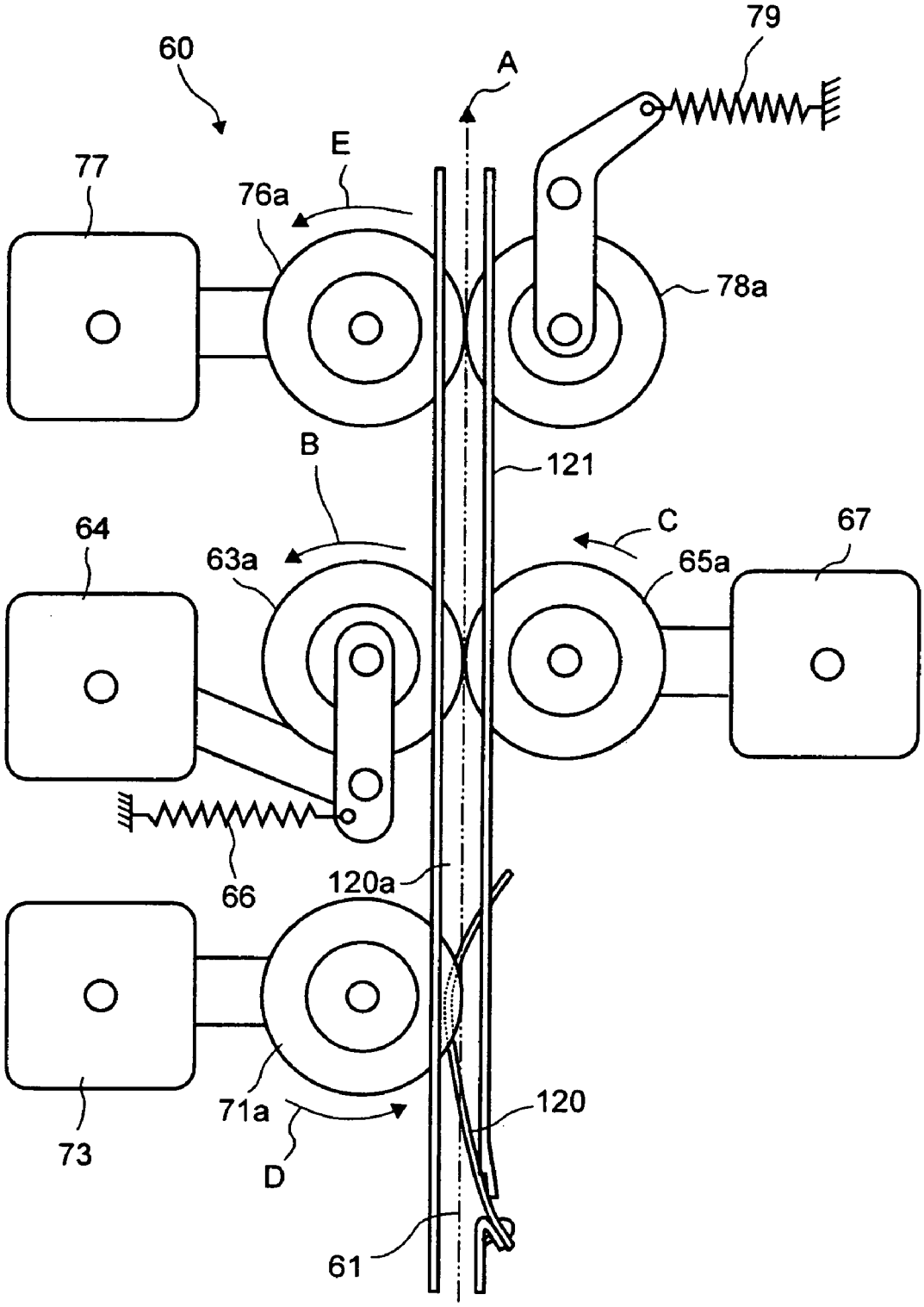
FIG. 14 is a schematic side view of an overlapped-sheet detection apparatus according to the seventh embodiment of the present invention.

Further, the provision of guide plate 120 can eliminate pinch roller 72*a* as shown in FIG. 14. In this case, guide plate 120 depresses sheets 1 against the second forwarding roller 71*a* and roller 71*a* applies conveying force to the sheets so that the sheets can be conveyed without pinch roller 72*a* shown in FIG. 13. Although, as shown in FIG. 14, convexly curved portion 120*a* of guide plate 120 is provided at the same position along the conveying direction as the sheet-contact portion of the second forwarding roller 71*a*, the depression force does not become too strong because no depression force is supplied by pinch roller 72*a*.

Seventh Embodiment

Figure 15:
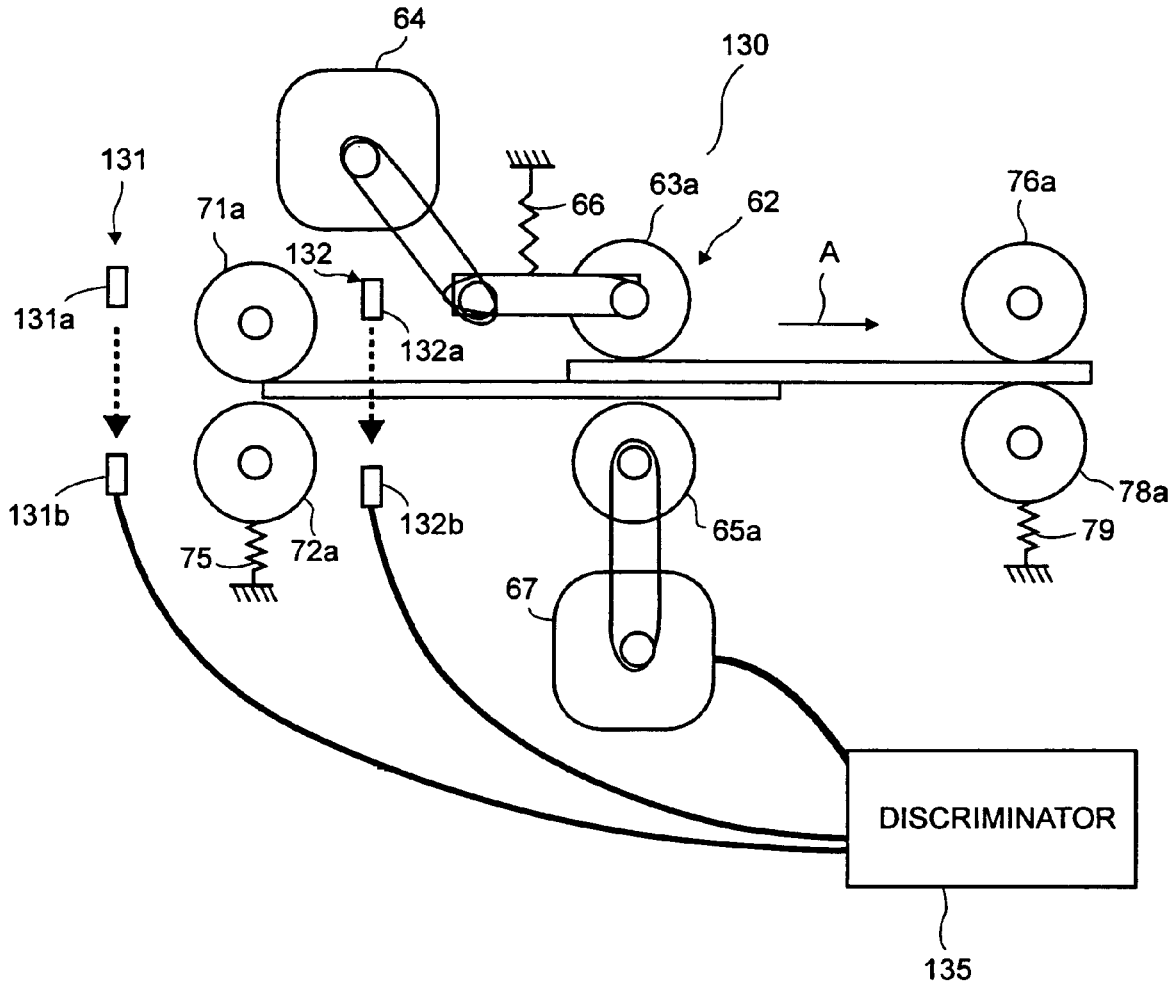
FIG. 15 is a schematic side view of an overlapped-sheet detection apparatus according to the eighth embodiment of the present invention.
Figure 16:
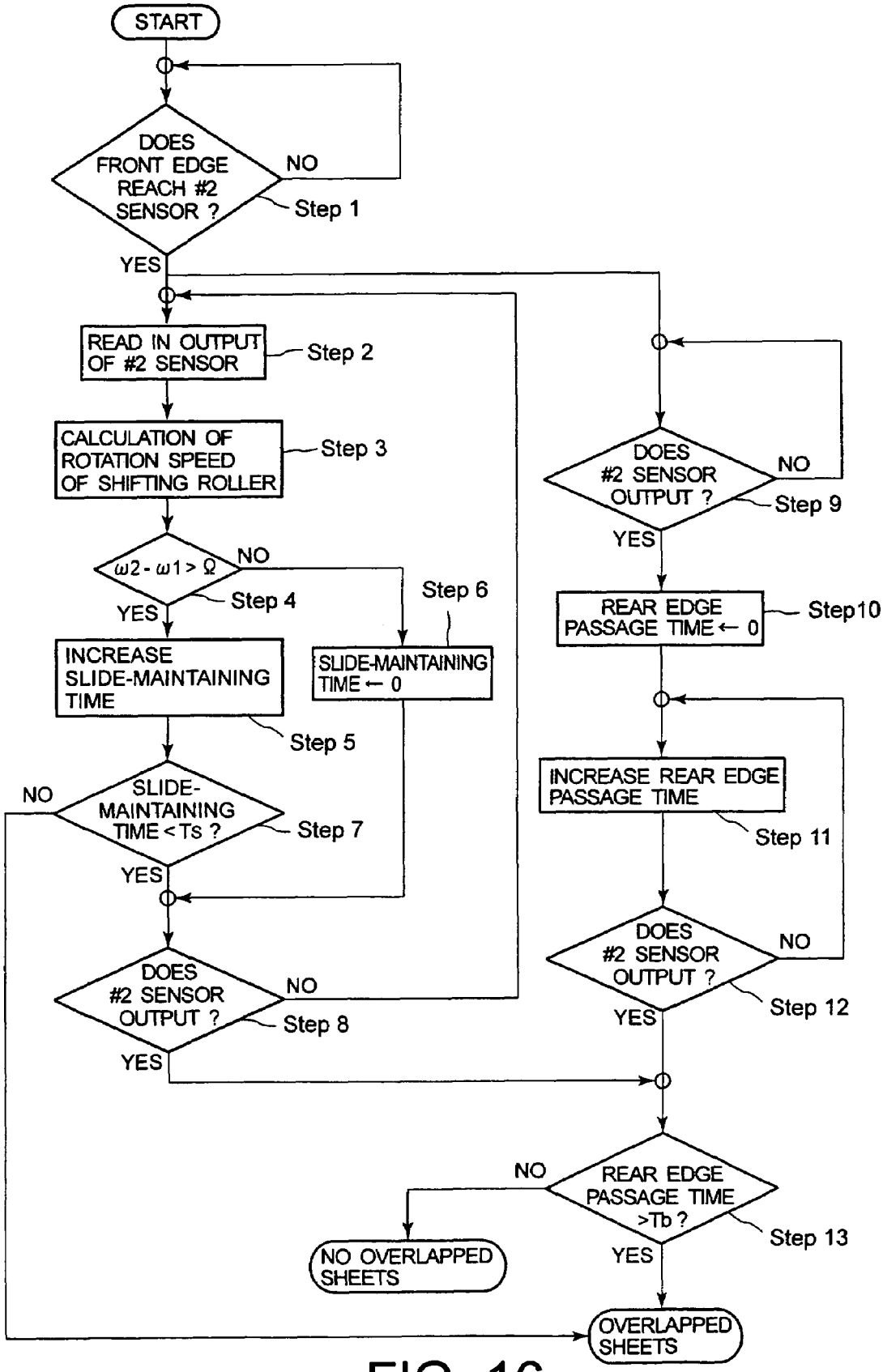
FIG. 16 is a flow chart of the overlapped-sheet detection apparatus shown in FIG. 15.

Next, an overlapped-sheet detection apparatus of the seventh embodiment in accordance with the present invention will be explained below with reference to FIGS. 15 and 16. Here, FIG. 15 is a schematic side view of overlapped-sheet detection apparatus 130 while FIG. 16 is a flow chart to explain operations of overlapped-sheet detection apparatus 130. As shown in FIG. 15, the first and second sensors 131 and 132 and discriminator 135 are added to the overlapped-sheet detection apparatus 60 of the sixth embodiment. The first sensor 131 is provided at the entrance of the overlapped-sheet detection apparatus 130 and the second sensor 132 is provided between the first sensor 131 and the first forwarding roller 63*a*. Overlapped-sheet detection apparatus 130 is substantially the same in structure and function as overlapped-sheet detection apparatus 60 shown in FIGS. 12 and 14 except for additional components of sensors 131 and 132 and discriminator 135. Thus, their same or similar reference numerals indicate the same or equivalent components and explanations about them are omitted.

A distance defined between the first sensor 131 and a sheet-pinch position of rollers 63*a* and 65*a* is shorter along the conveying direction than the shortest one of the sheets to be processed. The second sensor 132 is preferably provided near to the sheet-pinch position of rollers 63*a* and 65*a*. The first sensor 131 consists of light-emitting and light-receiving units 131*a* and 131*b* disposed opposite each other for light emitted from light-emitting unit 131*a* to cross conveying path 61. Similarly, the second sensor 132 consists of light-emitting and light-receiving units 132*a* and 132*b* disposed opposite to each other for light emitted from light-emitting unit 132*a* to cross conveying path 61. Since the distance between the first sensor 131 and the sheet-pinch position of rollers 63*a* and 65*a* is shorter than the shortest one of the sheets, the rear end of the sheets can be detected after rollers 63*a* and 65*a* take the front edge of the sheets at the sheet-pinch position, i.e., after the stable conveying of the sheets is established.

Discriminator 135 monitors the output of the encoder built in torque control motor 67, detects a rotation speed of shifting roller 65*a,* compares the rotation speed with a predetermined value, and determines whether the sheets are overlapped or not, as will be explained later. Discriminator 135 also monitors outputs of sensors 131 and 132, calculates time for the rear edge of the sheets to pass from sensor 131 through sensor 132, and determines whether the sheets are overlapped or not as will be explained below.

Operations of overlapped-sheet detection apparatus 130 will be now explained with reference to the flow chart shown in FIG. 16.

When discriminator 135 starts overlapped-sheet detection, discriminator 135 determines in accordance with an output from the second sensor 132 whether the front edge of sheets passes through the second sensor 132 (Step 1). When discriminator 135 determines that the front edge of sheets reaches the second sensor 132 (Step 1: YES), discriminator 135 carries out the first series of processes in Steps 2 through 8 and the second series of processes in Steps 9 through 13 at a fixed sampling rate.

In the first series of processes, discriminator 135 reads in the output from the encoder built in torque control motor 67, and calculates a difference between the current and one previous sampling outputs from the encoder and a rotation speed "ω1" of shifting roller 65*a* (Step 3). Discriminator 135 then calculates difference "ω2−ω1" between the rotation speed "ω1" of shifting roller 65*a* and a predetermined rotation speed "ω2" of forwarding roller 63*a* and compares the same with predetermined sliding threshold "Ω" (Step 4).

When discriminator 135 determines that difference "ω2−ω1" is greater than predetermined sliding threshold "Ω" (Step 4: YES), discriminator 135 judges that the sheets slide and increases slide-maintaining time (Step 5). When discriminator 135 determines, however, that difference "ω2−ω1" is less than predetermined sliding threshold "Ω" (Step 4: NO), discriminator 135 judges no substantial sliding of the sheets and moves to Step 8.

Discriminator 135 compares the increased slide-maintaining time at Step 5 with predetermined sliding threshold "Ts" (Step 7). When the increased slide-maintaining time is longer than the predetermined sliding threshold "Ts" (Step 7: NO), discriminator 135 judges the existence of the overlapped sheets and stops the operation.

When the increased slide-maintaining time is less than the predetermined sliding threshold "Ts" (Step 7: YES), discriminator 135 reads in the output of the second sensor 132 and judges whether the rear edge of the sheets passes the second sensor 132 (Step 8). When the passage of the rear edge of the sheets is not detected (Step 8: NO), discriminator 135 returns to Step 2 and repeats the processes up to Step 8.

When the passage of the rear edge of the sheets is judged (Step 8: YES), discriminator 135 regards the first series of processes as judgment of no overlapped state of sheets and moves to Step 13 for the second series of processes.

In the second series of processes, after judging that the front edge of the sheets reach the second sensor 132 at Step 1, discriminator 135 monitors the output of the first sensor 131 and judges whether the rear edge of the sheets passes through the first sensor 131 or not (Step 9). When the passage of the rear edge of the sheets is judged at Step 9 (Step 9: YES), discriminator 135 sets the passage time of the rear edge of the sheets to be zero (Step 10) and increases the passage time of the rear edge of the sheets (Step 12: NO and Step 11) until the second sensor 132 detects the passage of the rear edge of the sheets (Step 12: YES).

Discriminator 135 then detects the passage of the rear edge of the sheets at Step 12 through the second sensor 132 and compares predetermined threshold "Tb" of the rear edge passage time with the rear edge passage time increased at Step 11 (Step 13). When the rear edge passage time increased at Step 11 is longer than the threshold "Tb" (Step 13: YES), discriminator 135 judges the existence of the overlapped sheets. However, when the rear edge passage time increased at Step 11 is less than the threshold "Tb" (Step 13: NO), discriminator 135 judges no existence of the overlapped sheets.

As described above, according to the seventh embodiment discriminator 135 detects a rotation speed of shifting roller 65*a* in accordance with the output of the encoder built in torque control motor 67, calculates a difference of speed between the rotation speed of shifting roller 65*a* and a predetermined rotation speed of forwarding roller 63*a,* and determines that the sheets are overlapped when such a difference of speed is greater than a predetermined threshold for a period of time that is longer than a predetermined value. Further, two sensors 131 and 132 are provided at the entrance of the overlapped-sheet detection apparatus before a sheet-pinch position of forwarding and shifting rollers 63*a* and 65*a.* Since sensors 131 and 132 detect the rear edge of the sheets conveyed along conveying path 61, discriminator 135 compares passage time of the rear edge of the sheets between sensors 131 and 132 with a predetermined threshold and judges the existence of the overlapped sheets in the case that the passage time is longer than the threshold. In other words, in this embodiment, one of the first and second series of processes or both first and second series of processes can judge the existence of the overlapped sheets. Thus, its judgment level can be improved higher than the ones of the first through sixth embodiments.

The provision of two sensors 131 and 132 at the positions mentioned above leads to secure judgment of the existence of overlapped sheets even though collision of sheets makes forwarding roller 63*a* jump from conveying path 61. That is, when forwarding roller 63*a* jumps from conveying path 61, forwarding roller 63*a* is apart from shifting roller 65*a* and a load imposed on shifting roller 65*a* is reduced. As a consequence, shifting torque supplied to shifting roller 65*a* makes a rotation speed of shifting roller 65*a* slower. At this time changes in rotation speeds of shifting roller 65*a* are detected from the output of the encoder and the existence of overlapped sheets is sometimes mistakenly judged. However, in this embodiment, time that the rear edge of the sheets takes to pass through two sensors 131 and 132 is compared with a predetermined threshold so that a slower conveying speed of the sheets due to the shifting operation can be detected and that the problem of forwarding roller 63*a* jumping as set forth above can be solved.

Further, the overlapped-sheet detection apparatus 130 can be installed in an insecure conveying-state place. The overlapped-sheet detection apparatus 130 can be disposed, for example, just behind a take-up unit on conveying path 61 where sheets are taken up or just behind a gap adjustment unit where a conveying gap of sheets is adjusted. In short, since the overlapped-sheet detection apparatus 130 is provided with two separate sensors on conveying path 61 to detect the passage of the rear edge of the sheets, the sensors can detect the rear edge of the sheets in a stable state in which rollers 63*a* and 65*a* pinch at the front end of the sheets and a stable judgment of overlapped states of the sheets can be carried out regardless of states of the sheets.

Although the invention has been described in its preferred form with a certain degree of particularity, it is understood that the present disclosure of the preferred form has been changed in the details of construction and the combination and arrangement of components may be resorted to without departing from the spirit and the scope of the invention as hereinafter claimed. Some components of the embodiments may be eliminated or various components from different embodiments may also be combined.

Although the rotation direction (direction C) of shifting torque supplied to shifting roller 5 is the reverse of that of forwarding roller 4 in the embodiment as described above, the shifting torque may be changed in strength while it may be set in the same rotational direction as forwarding roller 4. In short, it is sufficient for shifting torque supplied to shifting roller to even slightly move sheets. Thus, if the rotation direction of the torque is set in the same as that of shifting roller, the shift of overlapped sheets can be minimized and the problem of a short conveying interval can be eased.

In addition, a pair of rollers 4 and 5 or similar components in the embodiments each may be a plurality of sets of rollers. The encoder built in torque control motor 6 may be replaced by one provided separately from the torque motor or by other rotation detection means.

What is claimed is:

1. An overlapped-sheet detection apparatus comprising:

a forwarding roller to forward sheets in a conveying direction along a conveying path;

a shifting roller positioned adjacent to said forwarding roller to pinch said sheets between said shifting roller and said forwarding roller, said shifting roller being configured to shift said sheets if said sheets are overlapped and to follow a rotation of said forwarding roller if said sheets are not overlapped;

driving torque means for supplying said shifting roller with a driving torque to shift said sheets;

a first sensor disposed upstream of said forwarding roller to detect a rear edge portion of said sheets in the conveying direction;

a second sensor disposed between said first sensor and said forwarding roller to detect said rear edge portion of said sheets in the conveying direction; and discrimination means for judging if said sheets are overlapped based upon a period of time between detection of said rear edge portion by said first sensor and detection of said rear edge portion by said second sensor.

2. An overlapped-sheet detection apparatus comprising:

a forwarding roller to forward sheets in a conveying direction along a conveying path;

a shifting roller positioned adjacent to said forwarding roller to pinch said sheets between said shifting roller and said forwarding roller, said shifting roller being configured to shift said sheets if said sheets are overlapped and to follow a rotation of said forwarding roller if said sheets are not overlapped;

driving torque means for supplying said shifting roller with a driving torque to shift said sheets;

detection means for detecting a rotation speed of said shifting roller;

first discrimination means for judging if said sheets are overlapped based upon a determination that a difference between said rotation speed of said shifting roller and a rotation speed of said forwarding roller is greater than a threshold value;

a first sensor disposed upstream of said forwarding roller to detecting a rear edge portion of said sheets in said conveying direction;

a second sensor disposed between said first sensor and said forwarding roller to detect said rear edge portion of said sheets in said conveying direction; and second discrimination means for judging if said sheets are overlapped based upon a period of time between detection of said rear edge portion by said first sensor and detection of said rear edge portion by said second sensor.

3. An overlapped-sheet detection apparatus according to claim 2, wherein said first sensor is disposed upstream of said forwarding and shifting rollers by a predetermined distance that is less than a length of a shortest one of said sheets.

4. An overlapping-sheet detection apparatus according to claim 1, wherein said first sensor is disposed upstream of said forwarding and shifting rollers by a predetermined distance that is less than a length of a shortest one of said sheets.

* * * * *